United States Patent [19]

Strombeck

[11] Patent Number: 4,569,184

[45] Date of Patent: Feb. 11, 1986

[54] MACHINE FOR ERECTING, FILLING AND CLOSING CARTONS

[76] Inventor: Leo Strombeck, 2405 Twenty-Second St., Rockford, Ill. 61108

[21] Appl. No.: 525,407

[22] Filed: Aug. 22, 1983

Related U.S. Application Data

[63] Continuation-in-part of Ser. No. 319,095, Nov. 8, 1981, Pat. No. 4,471,601.

[51] Int. Cl.[4] ..... B65B 43/28; B65B 7/16

[52] U.S. Cl. ..... 53/564; 53/284; 53/374; 53/387

[58] Field of Search ..... 53/374, 387, 284, 564, 53/218; 493/171, 474

[56] References Cited

U.S. PATENT DOCUMENTS

| | | | |
|---|---|---|---|
| 2,263,739 | 11/1941 | Rose | 53/374 |
| 2,612,016 | 9/1952 | Anderson . | |
| 2,804,738 | 9/1957 | Shenigo | 53/387 X |
| 3,039,370 | 6/1962 | King | 53/387 X |
| 3,206,915 | 9/1965 | Anderson et al. . | |
| 3,350,841 | 11/1967 | McDonald | 53/374 X |
| 3,364,651 | 1/1968 | Stohlquist . | |
| 3,442,063 | 5/1969 | Martin | 53/374 |
| 3,466,838 | 9/1969 | Sorensen et al. . | |
| 3,634,995 | 1/1972 | Curtis | 53/387 X |
| 4,239,115 | 12/1980 | Froom . | |

*Primary Examiner*—John Sipos
*Attorney, Agent, or Firm*—Vernon J. Pillote

[57] ABSTRACT

An intermittently cycled packaging machine for erecting, filling, closing and sealing cartons with hot melt adhesive. A reciprocation carton transfer mechanism is cycled in response to filling of a carton at the filling station and is operative to advance cartons in step fashion from a carton erecting station through a lower carton closing zone, the filling station and through an upper carton closing zone with the last flap to be folded at the lead side of the carton, and the adhesive applying nozzles and the lead flap folding apparatus are located in relation to each other and to the stroke of the transfer mechanism such that adhesive is applied to the end flaps on the carton and the lead flap is infolded as the carton is advanced in a continuous forward step. The upper carton closing zone includes movably mounted flap folding arms arranged to infold one side flap and the trail flap on the upper end of the carton while the carton is dwelling at one dwell position. The upper carton closing zone also has a carton reshaping mechanism arranged to press the upper portions of the lead and trail panels toward each other while the adhesive is setting. Carton stabilizers are provided on the elevator to retain the carton in position in the elevator during raising and lowering of the carton. A power operated flap depressor is provided for depressing the lead flap in advance of the filling station.

14 Claims, 36 Drawing Figures

17
71
207
251a
201'
241
242
241a
243
246
247
244
245
135
32
203b'
203a'
202'
206a'
44a
X6
X4
229
73'
233
231
236
228
44b
43d
43e
165
235
234
X5
44
43
161
74'
225
226
227
31
203b'
203a'
247
241a
243
135
251a
207
201'
241
242
243
244
245
246
135
32
135
206a'
X6
X4
44b
44a
43b
43e
229
73'
233
165
74'
236
228
234
231
235
225
226
227
44
X5
43
161

20
228
73'
235
229
35
251a
232
225
165'
31
32
74'
19
251b
X7
273
271
271a
273a
274
275
280
279
268
265
259
261
255
X8
278
272
258a
258
23
284
287
286
311
305
306
301
302
302a
282
X9
312

72
71
207
203b'
44b
228
234
16
235
73'
225
226
229
233
231
X6
251a
32
227
165
85
84
74'
76
251b
X7
283
271
271b
282
278b
280
272
278c
271a
278
278a
251c
251d
251e
285b
288
286
X8
285a
287
287a
305
306
311
313
314
315
314a
312
X9

MACHINE FOR ERECTING, FILLING AND CLOSING CARTONS

This application is a continuation-in-part of my copending application Ser. No. 06/319,095, filed Nov. 8, 1981, for "Machine For Erecting, Filling and Closing Cartons now U.S. Pat. No. 4,471,601.

BACKGROUND OF THE INVENTION

Packaging machines have heretofore been made for example as shown in U.S. Pat. Nos. 2,612,016; 3,206,915; 3,364,651 and 3,466,838 for packaging material in rectangular cartons which are initially supplied in a flattened condition and have four body panels interconnected along fold lines to form a rectangular body and closure flaps interconnected along fold lines to the four body panels for closing ends of the carton. In general, the packaging machines disclosed in the aforementioned patents are arranged to open and erect carton blanks at a carton infeed station and have a transfer mechanism mounted for extension and retraction along a path and operative when driven through a transfer cycle to advance a series of cartons in step fashion from the infeed station sequentially past a lower carton closing station; a filling station; and an upper carton closing station. In these packaging machines, product is dispensed in continuous fashion through a downwardly opening nozzle at the filling station and an elevator at the filling station is operated in timed relation with the transfer mechanism to elevate a carton into partial telescoping relation with the nozzle and then allow the carton to move down as it is filled. When the carton at the filling station reaches a preselected lower position, a transfer cycle is initiated to advance the series of cartons along the path in a forward step. Such packaging machines are herein referred to as intermittently cycled packaging machines.

Some prior intermittently cycled packaging machines such as disclosed in U.S. Pat. Nos. 2,612,016 and 3,364,651 are adapted to handle cartons having mechanically interlocking end flaps on the narrow side panels of the cartons and such machines were arranged to first infold the end flaps on the wide panels of the carton and then infold and interlock the end flaps on the narrow side panels. U.S. Pat. No. 3,206,915 also discloses an intermittently cycled packaging machine adapted for handling cartons having mechanical interlocking end flaps, and this patent further discloses an adhesive applying attachment at the outlet end of the packaging machine to adapt the machine to handle chest-type cartons that have, in addition to the mechanical interlocking end flaps, a tab at each end of the cover flange which is adpated to be secured to an end flap on an adjacent side panel of the carton. The adhesive applying attachment in U.S. Pat. No. 3,206,915 was arranged to move the filled and closed cartons crosswise of the outlet end of the packaging machine; apply a spot of glue to the top and bottoms of the cartons while the cartons were at rest; and then advance the cartons past upper and lower plows that folded the end tabs onto the glue spots. Some other intermittently cycled packaging machines such as shown in U.S. Pat. No. 3,466,838 are arranged to erect, fill, close, and heat seal cartons having pre-glued end flaps, with heat sealers arranged to heat the pre-glued end flaps after both ends of the carton were closed and while the cartons were at rest during a dwell period between transfer cycles.

U.S. Pat. No. 4,239,115 discloses a carton construction adapted to have the end flaps closed and sealed with hot melt adhesive when the end flaps are folded in a particular sequence and the adhesive is applied in a particular adhesive pattern. More specifically, the carton in this patent has the end flap on one wide side panel dimensioned so that, when infolded last, it overlaps portions of the other three end flaps, and closing of the carton is effected by sequentially infolding the end flaps on the two narrow side panels; infolding the end flap on the other wide side panel; applying hot melt adhesive on the infolded end flaps in bands paralleling the narrow side panels, and then infolding the end flap on the first mentioned wide side panel.

The adaptation of intermittently cycled packaging machines of the type described above to the closing and sealing of such cartons with hot melt adhesive has presented various problems. Such packaging machines have a dwell period between each transfer cycle to allow time for dispensing the required quantity of product from the nozzle into the carton at the fill station. The dwell period of the machine will vary dependent on the rate to which the product is dispensed from the nozzle into the cartons, and the glue application and flap folding should be so arranged that reliable sealing is effected independent of variations in the packaging machine fill time. Further, since the product is dispensed continuously from the nozzle on the packaging machine, it is desirable to advance the carton past the nozzle with the wide side panels of the carton transverse to the path of movement of the carton, in order to minimize the amount of material that flows from the nozzle during movement of the filled carton away from the nozzle and the next empty carton into position below the nozzle. The glue application and flap folding must therefore also be arranged so that it will apply adhesive in the proper pattern on the infolded end flaps on the carton and rapidly fold the final end flap onto the adhesive, when the carton is oriented with the wide side panels extending crosswise of the path of advance of the cartons in the packaging machine. Further, the lower flap folding and adhesive applying mechanism must be capable of closing the lower ends of the cartons when they are empty while the upper flap folding and adhesive applying mechanism must be capable of closing the cartons when they are filled. Closing and sealing the upper end of the cartons has presented special problems due in part to the necessity of outfolding the upper flaps to enable filling, and in part to bulging of the carton by the product when it is filled.

OBJECTS OF THE INVENTION

An important object of this invention is to provide an intermittently cycled packaging machine which is arranged to close and seal the end flaps on the cartons utilizing a hot melt adhesive.

Another object of this invention is to provide an intermittently cycled packaging machine in accordance with the forgoing object, and in which the application of adhesive to the end flaps on the cartons and the folding of the last flap on the end of the carton is effected while the transfer mechanism is advancing the carton in a single continuous forward step, to rapidly infold the last end flap onto the hot melt adhesive before the latter can start to set.

Another object of this invention is to provide an intermittently cycled packaging machine in accordance with the foregoing object which is arranged to advance the cartons through the machine with the last end flap to be folded at the lead side of the carton and which has an improved arrangement for infolding the flaps on the upper end of the carton.

Another object of this invention is to provide an intermittently cycled packaging machine which is arranged to close and seal the end flaps on the carton using a hot melt adhesive, and which reshapes the upper end of the carton to counteract bulging of the upper end of the carton, after the carton is closed and while the adhesives on the upper end flaps is setting.

Another object of this invention is to provide an intermittently cycled packaging machine having an improved arrangement for controlling the position of the carton on the elevator during raising and lowering of the carton at the filling station.

Still another object of this invention is to provide an intermittently cycled packaging machine having an improved arrangement for depressing the lead flap on the carton before it reaches the filling station to avoid interference with the trailing flap on the carton being elevated at the filling station and to prevent the lead flap from contacting the material emerging from the dispensing nozzle as the carton is advanced to a position below the nozzle.

These, together with objects of this invention will be more readily appreciated as the invention becomes better understood by reference to the following detailed description, when taken in connection with the accompanying drawings wherein.

Figure 1:
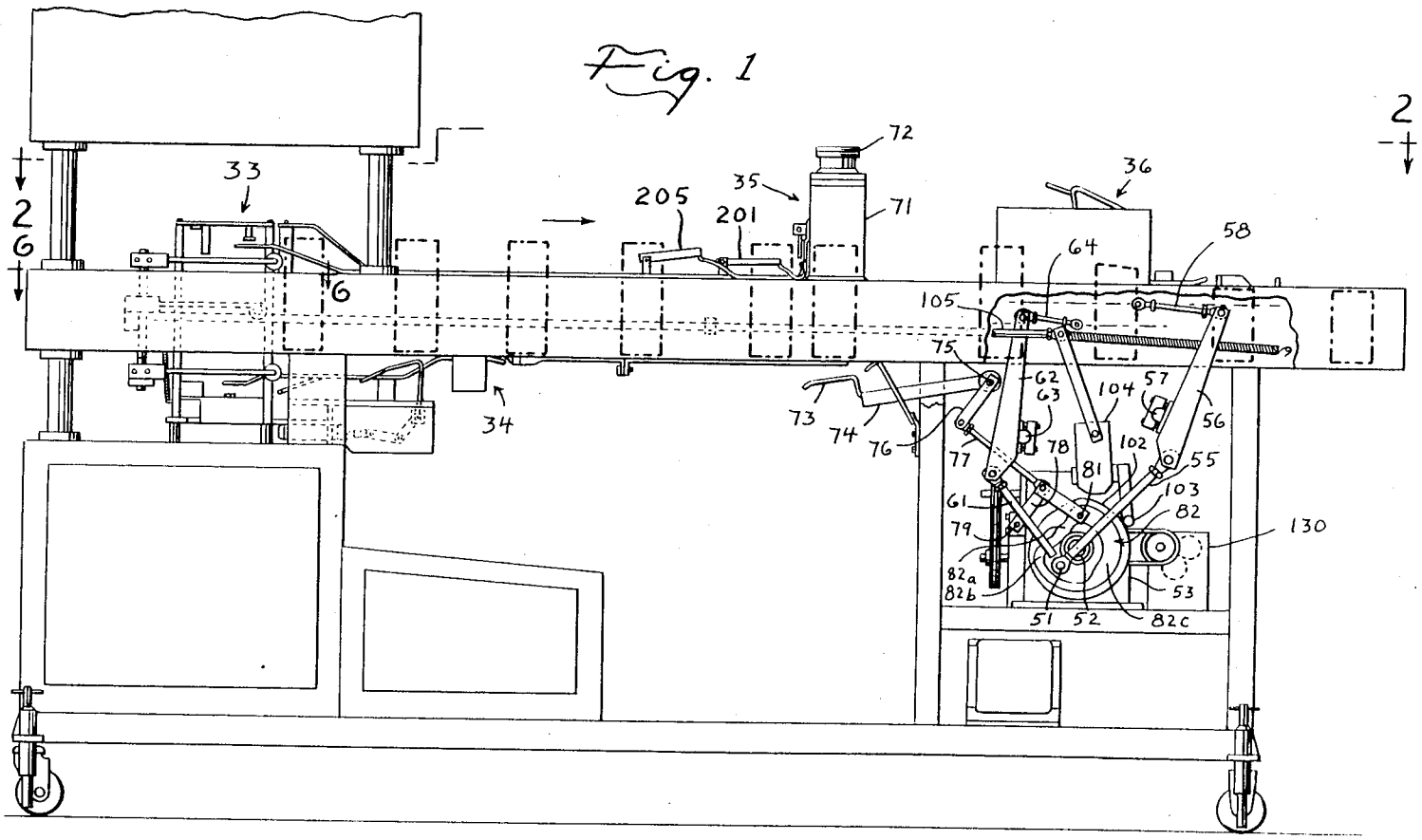
FIG. 1 is a side elevational view of a packaging machine.
Figure 2:
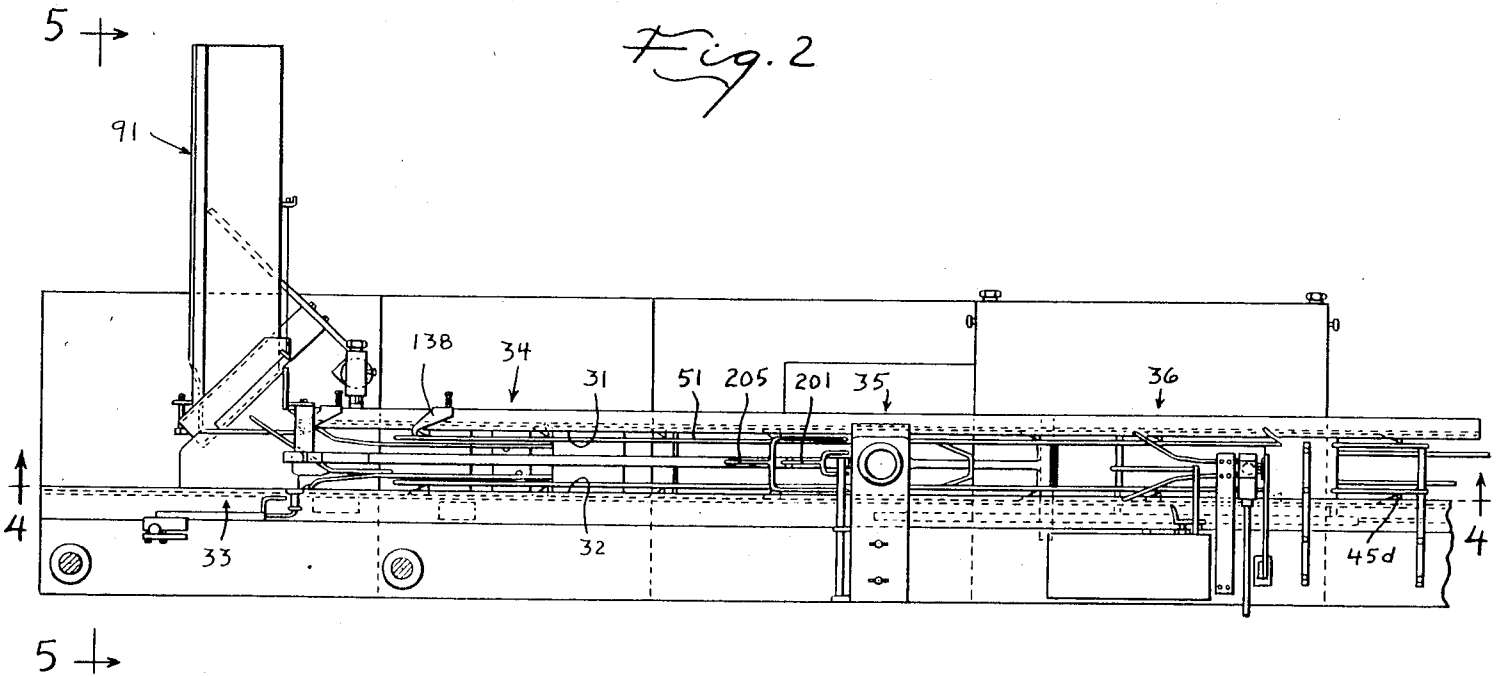
FIG. 2 is a top plan view of the packaging machine.
Figure 3:
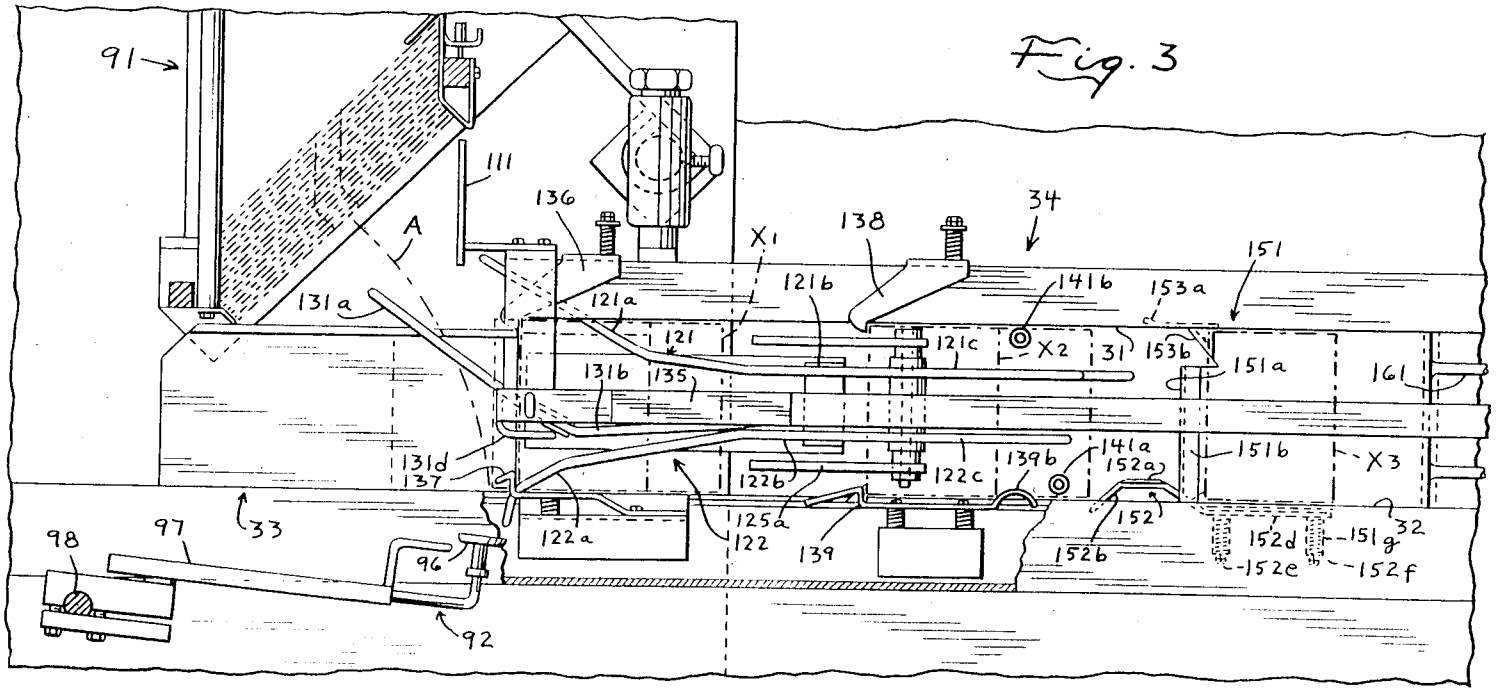
FIG. 3 is a fragmentary top plan view showing an inlet portion of the packaging machine on a larger scale than FIG. 1.
Figure 3A:
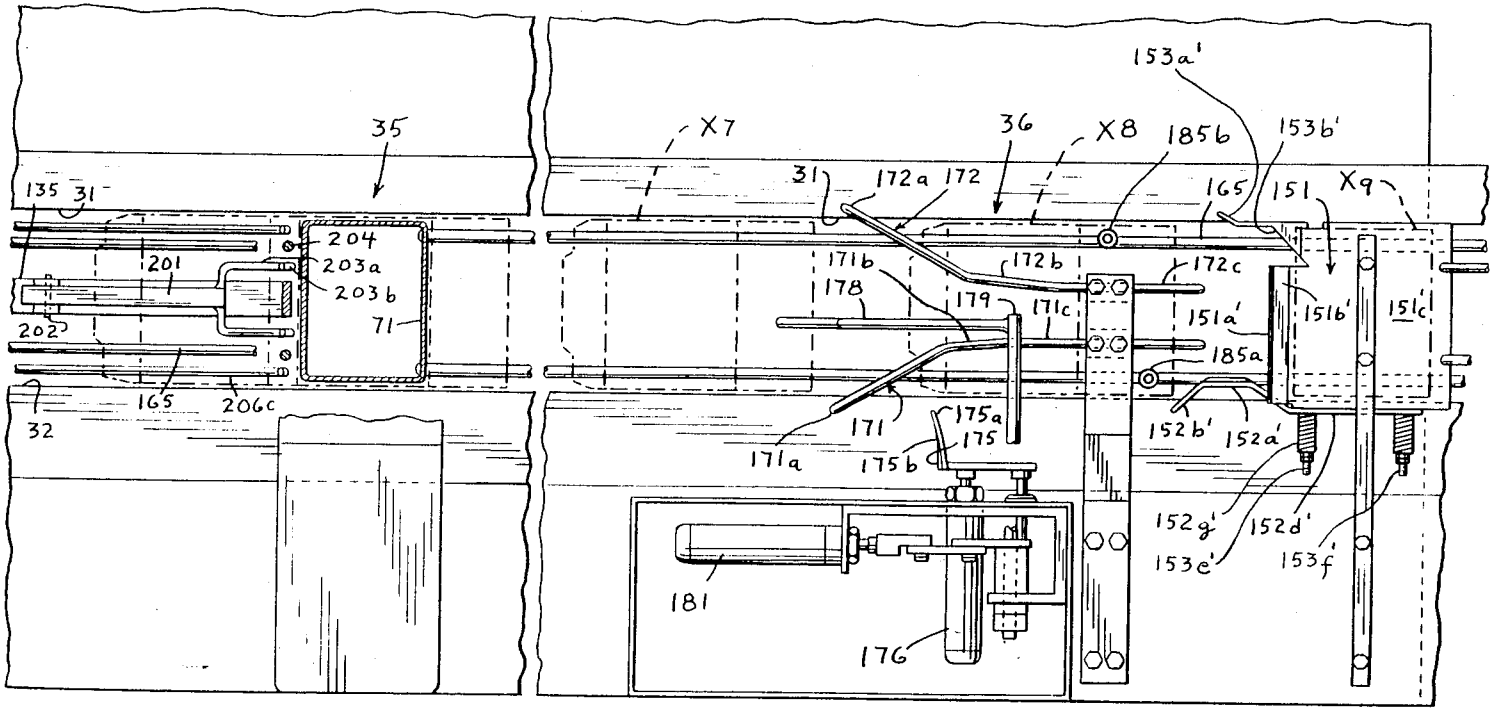
Figure 4:
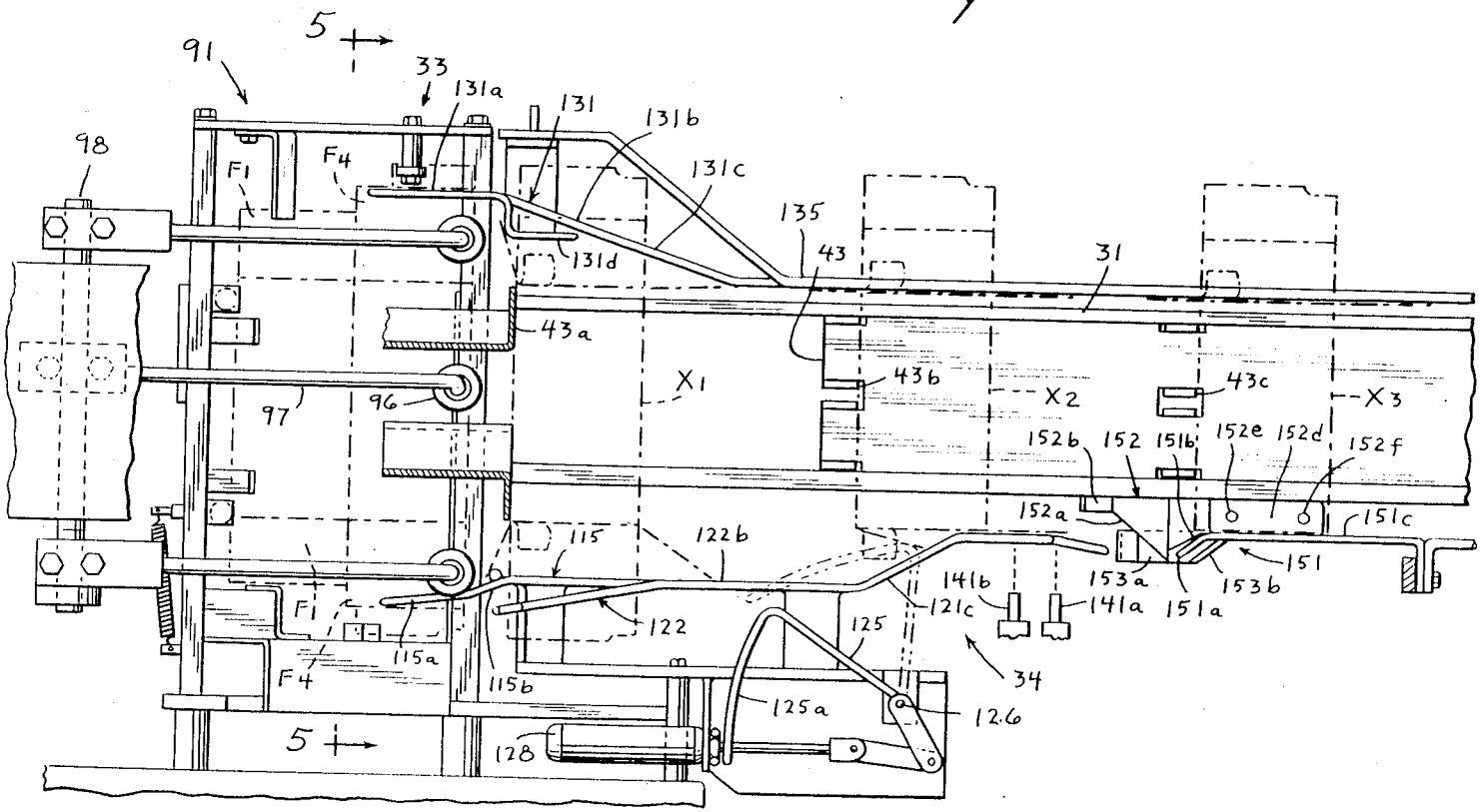
Figure 4A:
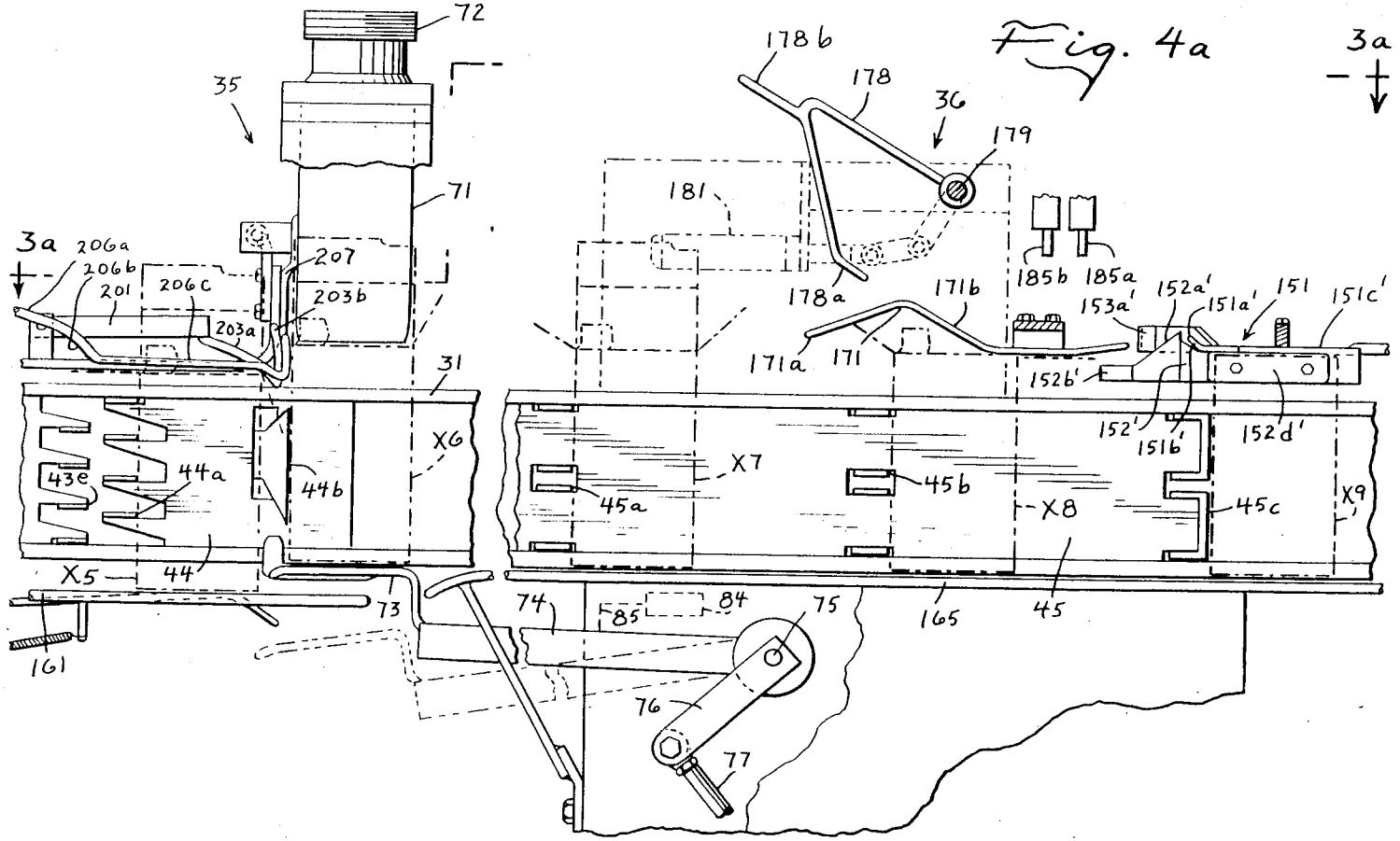
Figure 5:
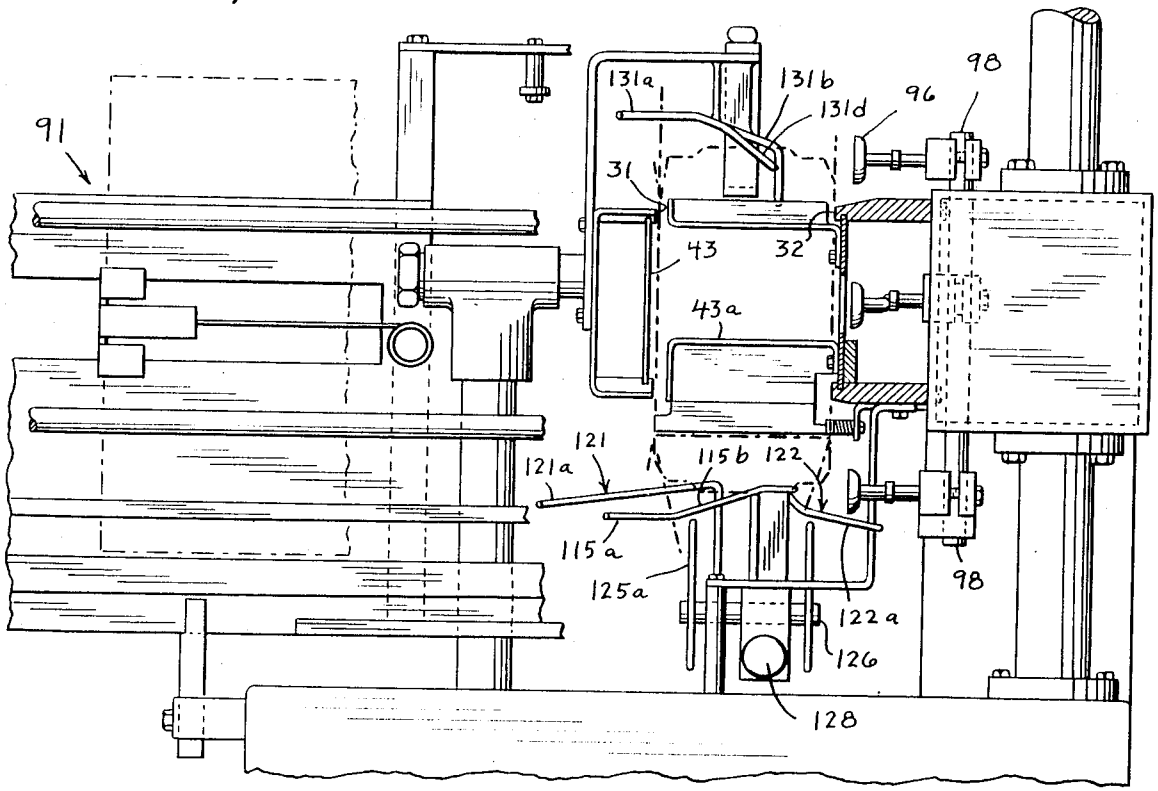
Figure 10:
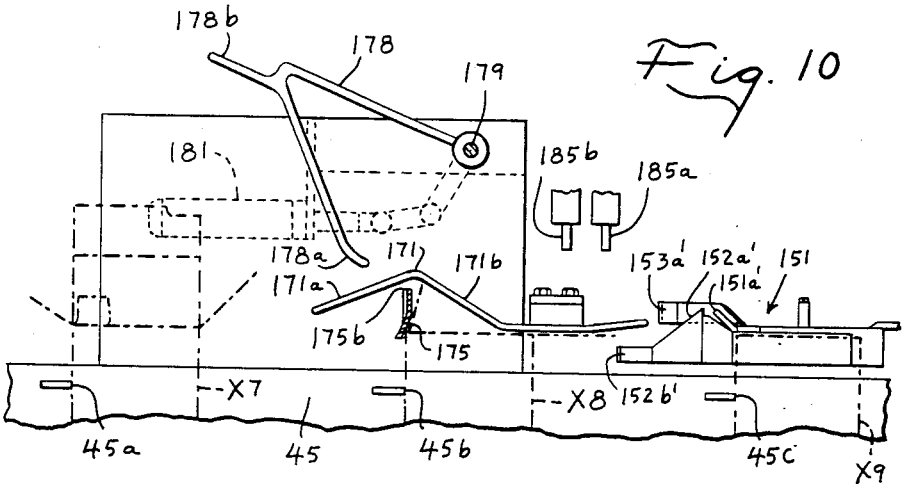
Figure 11:
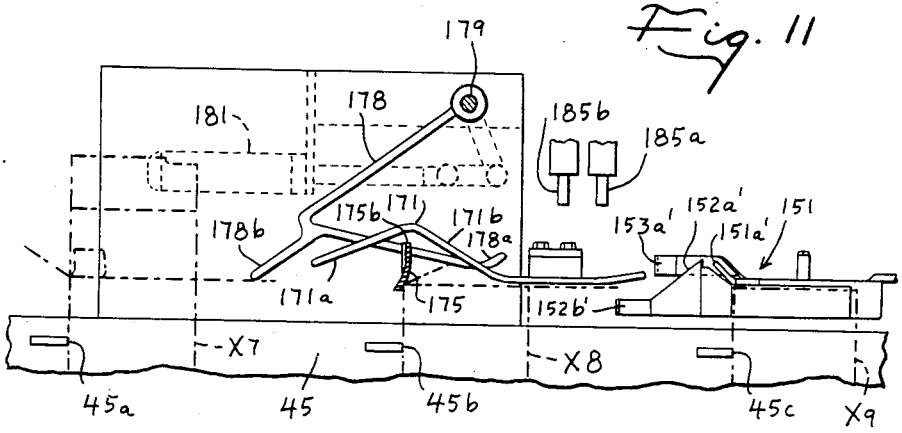
Figure 12:
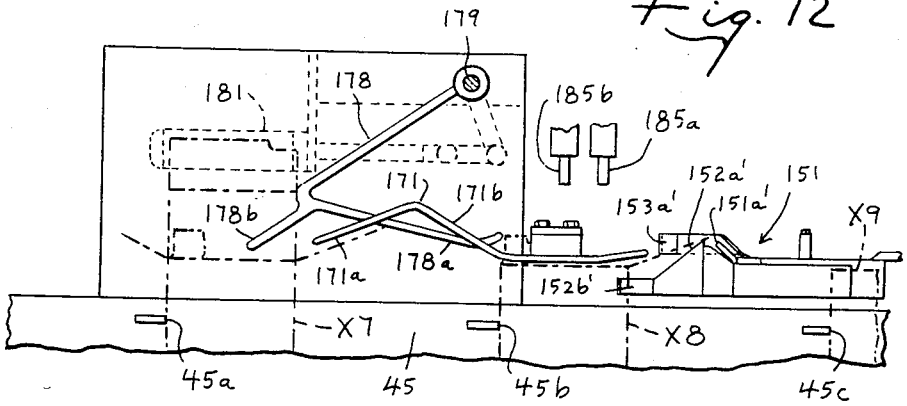
Figures 13, 14, 17:
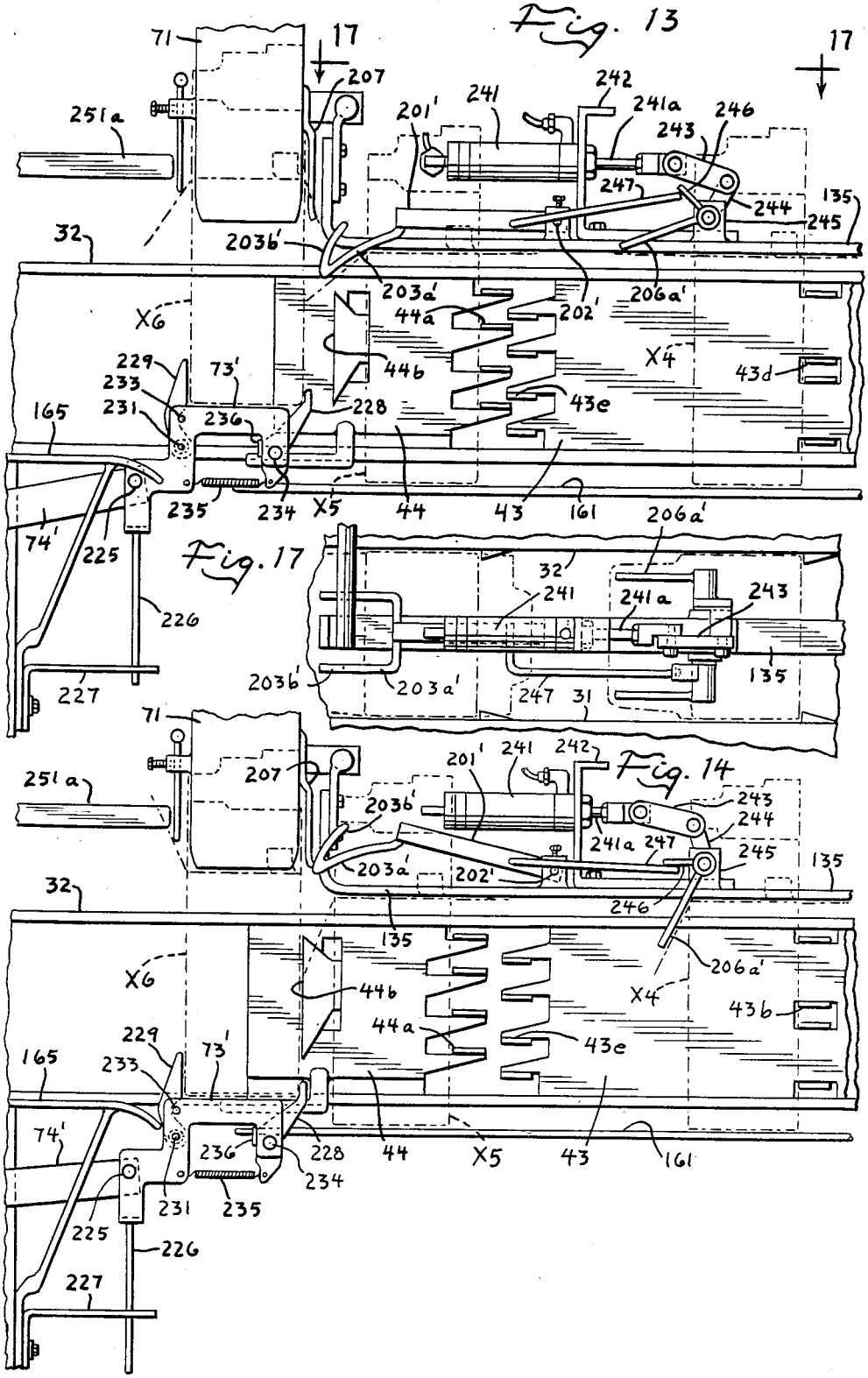
Figures 18, 19:
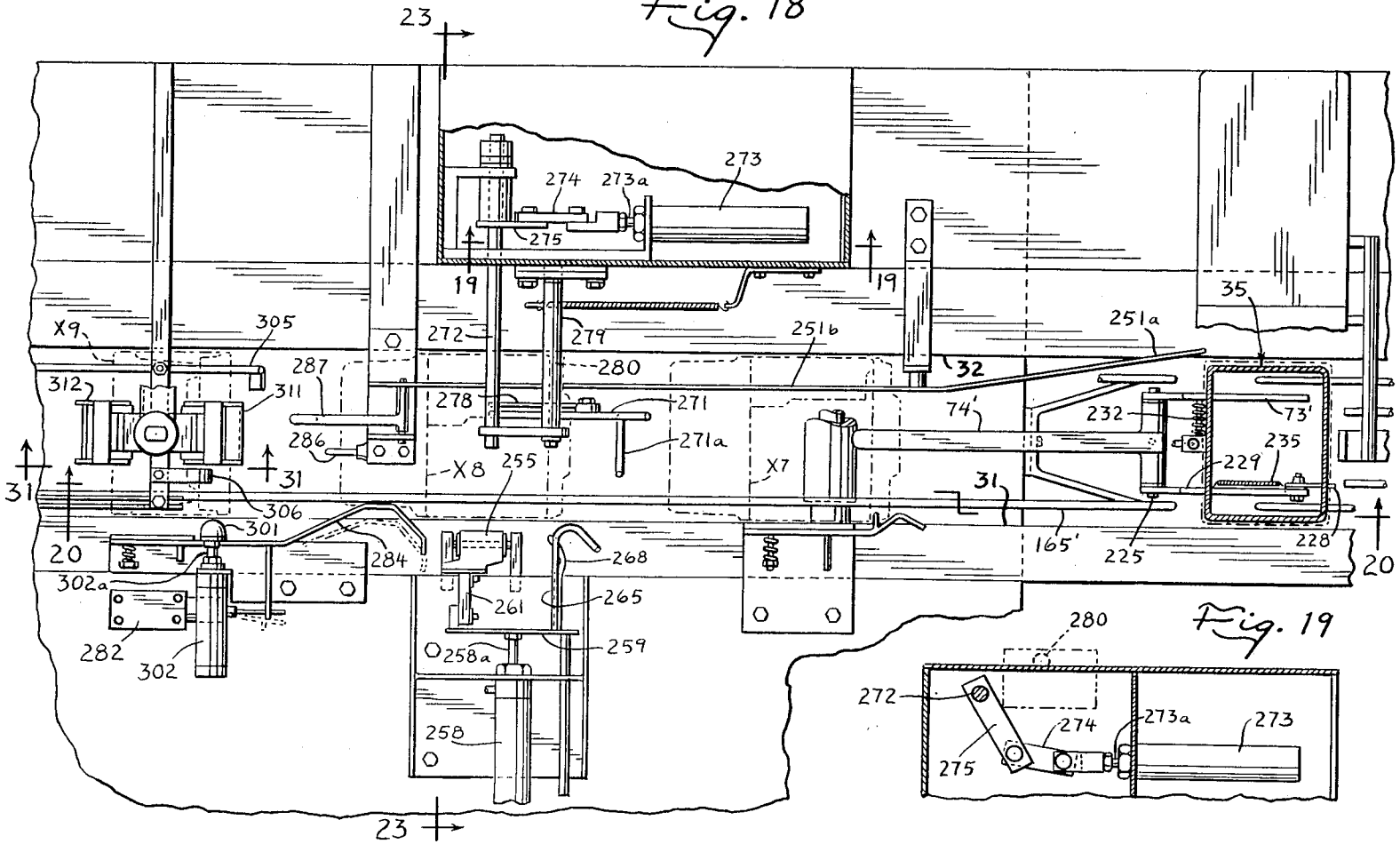
Figures 20, 21, 22:
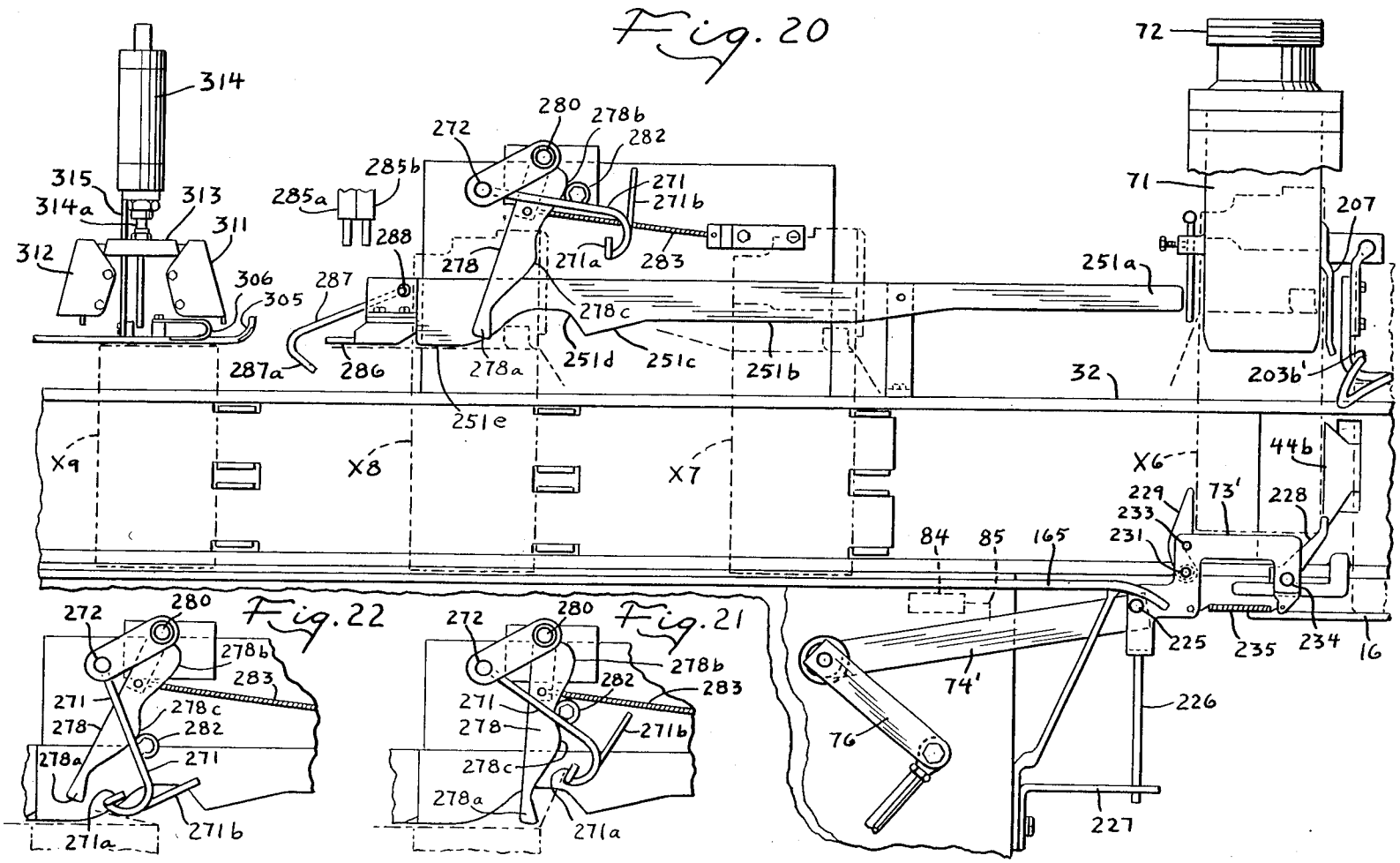
Figure 23:
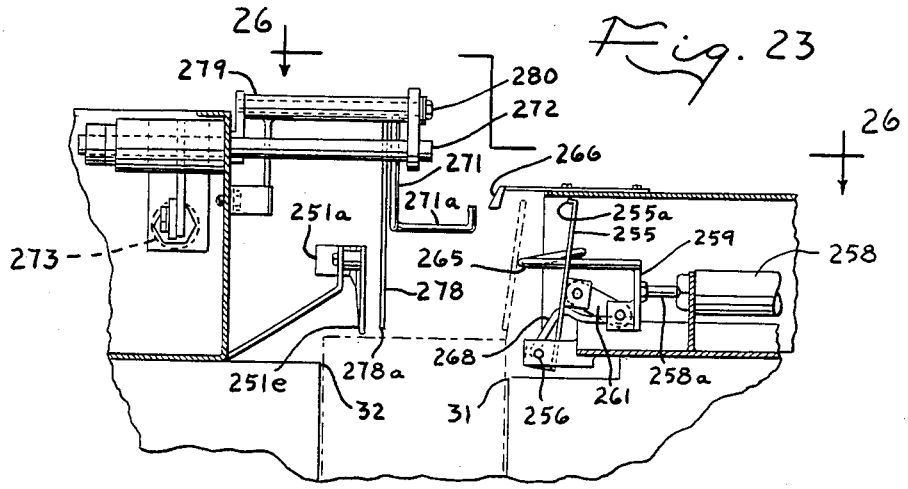
Figure 24:
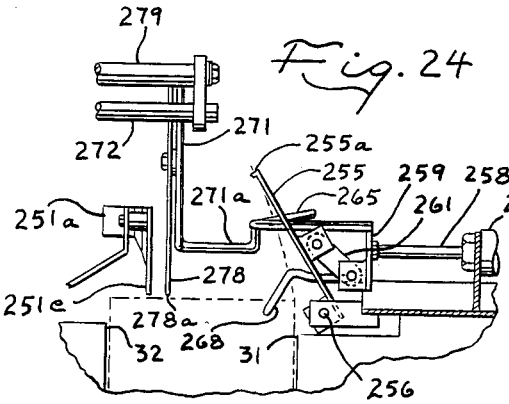
Figure 25:
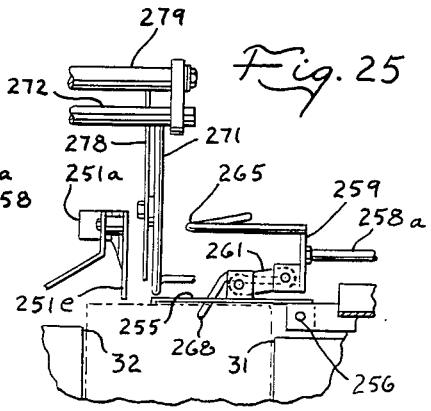
Figure 26:
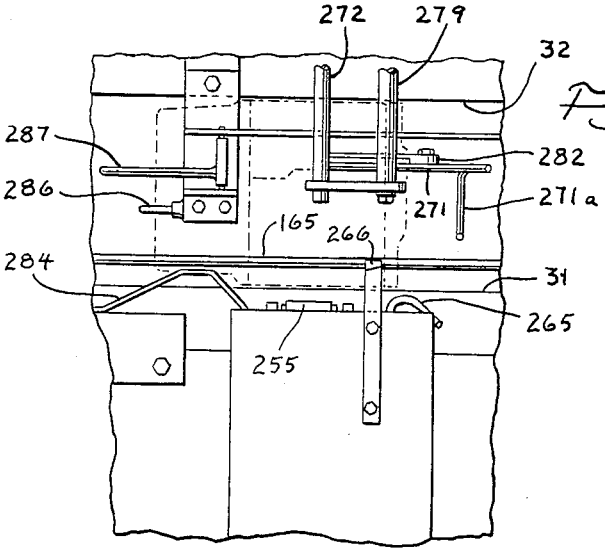
Figure 27:
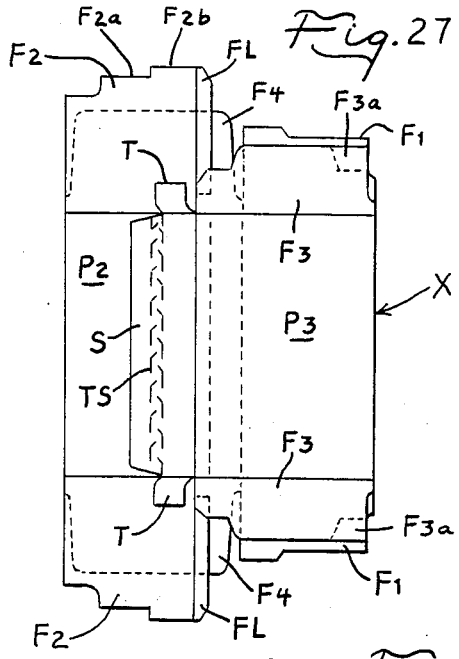
Figure 28:
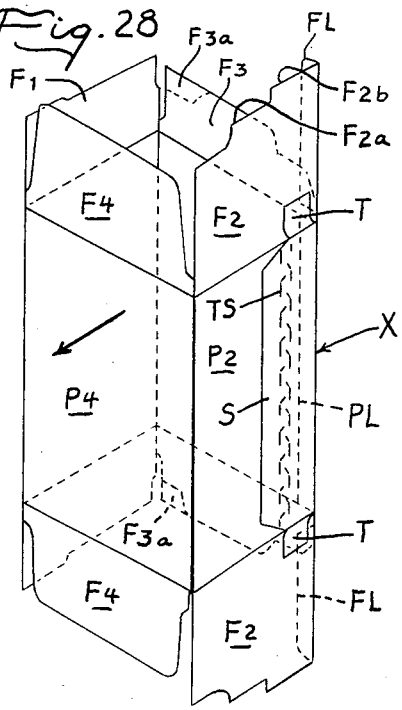
Figure 29:
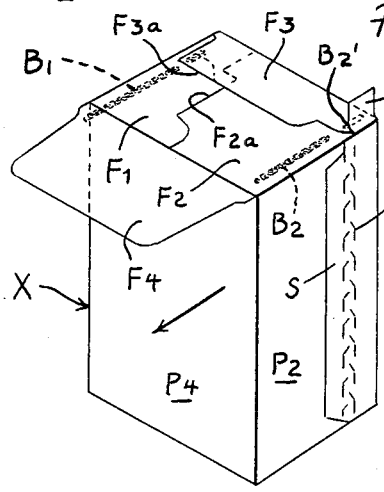
Figure 30:
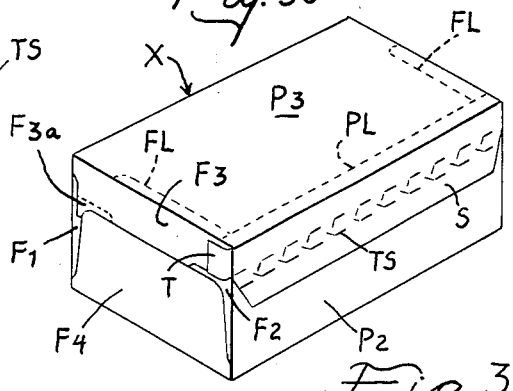
Figure 34:
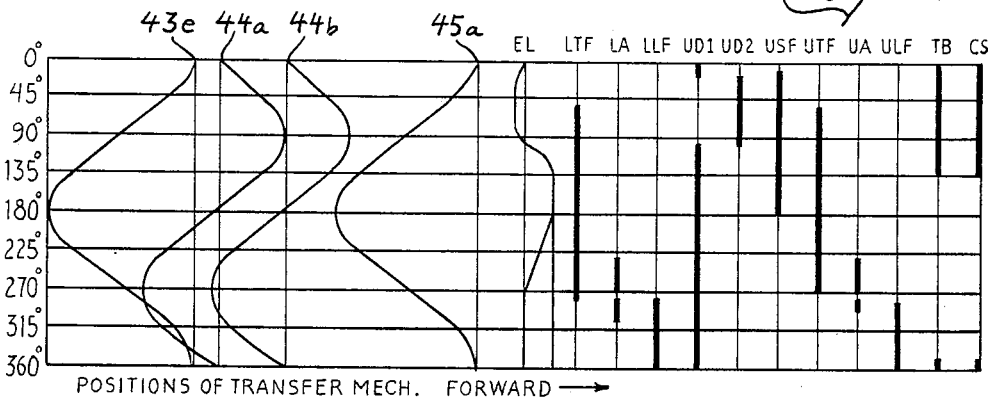
Figure 31:
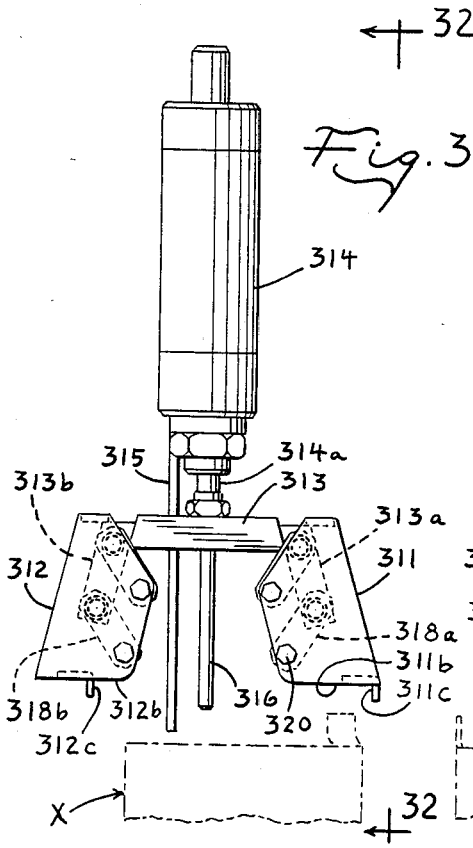
Figure 32:
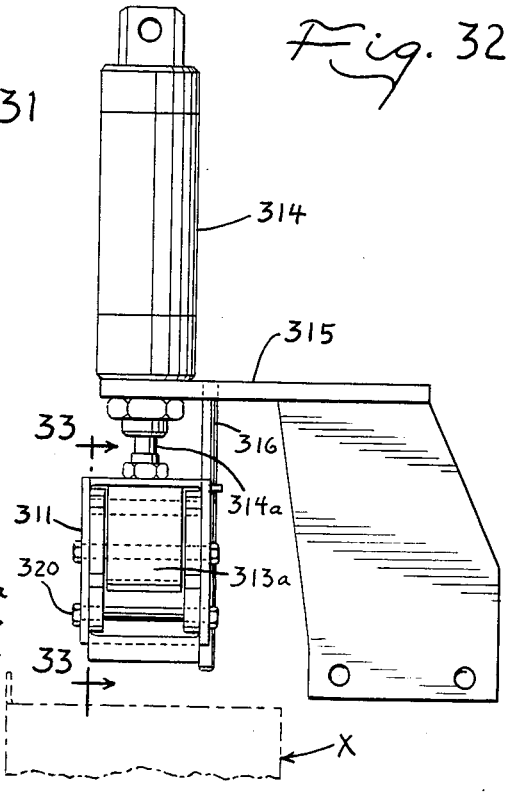
Figure 33:
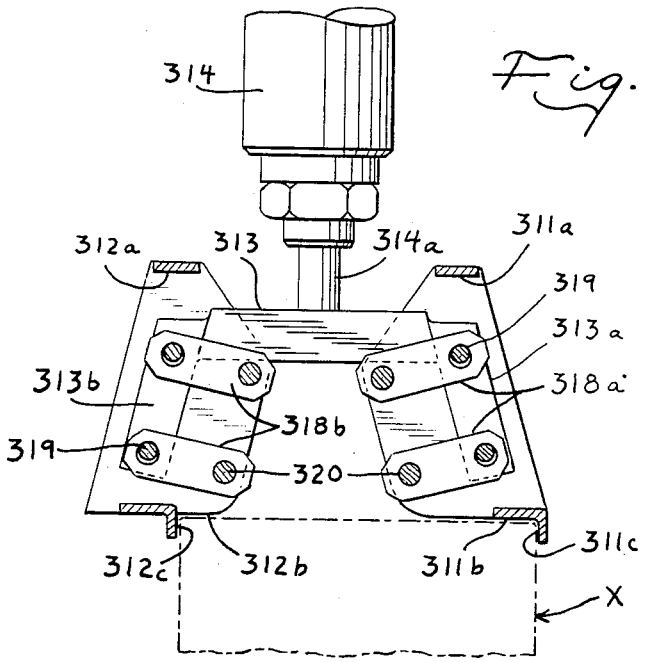

FIG. 3*a* is a fragmentary top plan view showing an outlet portion of the packaging machine on a larger scale than FIG. 1;

FIG. 4 is a fragmentary vertical sectional view taken on the plane 4—4 of FIG. 2, showing an inlet portion of the packaging machine on a larger scale than FIG. 2;

FIG. 4*a* is a fragmentary vertical sectional view taken on the plane 4—4 of FIG. 2 showing an outlet portion of the packaging machine on a larger scale than FIG. 2;

FIG. 5 is a fragmentary end elevational view of the packaging machine taken on the plane 5—5 of FIG. 2, showing the parts on a larger scale than FIG. 2;

FIGS. 6, 7, 8 and 9 are fragmentary horizontal sectional views taken on the plane 6—6 of FIG. 1 and illustrating the carton infeed mechanism in different moved positions;

FIGS. 10, 11 and 12 are fragmentary views schemmatically illustrating the upper flap closing mechanism and the carton transfer mechanism in different moved positions;

FIGS. 13–16 are fragmentary vertical sectional views through the packaging machine adjacent the carton filling station and illustrating a modified form of carton elevator and upper lead flap depressor mechanism;

FIG. 17 is a fragmentary horizontal plan view taken on the plane 17—17 of FIG. 13;

FIG. 18 is a fragmentary plan view illustrating a modified form of upper flap folding mechanism;

FIG. 19 is a fragmentary vertical sectional view taken on the plane 19—19 of FIG. 18;

FIG. 20 is a fragmentary vertical sectional view taken on the plane 20—20 of FIG. 18;

FIGS. 21 and 22 are fragmentary sectional views taken on the plane 20—20 of FIG. 18, illustrating parts in different moved positions;

FIGS. 23–25 are fragmentary transverse sectional views taken on the plane 23—23 of FIG. 18 and illustrating parts in different moved positions;

FIG. 26 is a fragmentary horizontal sectional view taken on the plane 26—26 of FIG. 23;

FIG. 27 is a side view of a carton blank adapted to be erected and filled by the packaging machine;

FIG. 28 is a perspective view of the carton in an erected condition;

FIG. 29 is a perspective view of the carton and illustrating the carton in a partially closed condition;

FIG. 30 is a perspective view of the carton in a closed condition;

FIG. 31 is a fragmentary sectional view taken in the plane 31—31 of FIG. 18 and showing the parts on a larger scale than in FIG. 18;

FIG. 32 is a fragmentary transverse sectional view taken on the plane 32—32 of FIG. 31;

FIG. 33 is a fragmentary sectional view taken on the plane 33—33 of FIG. 32 and showing the parts in a moved position and on a larger scale than FIG. 32; and FIG. 34 is a timing diagram for the packaging machine.

The present invention relates to an intermittently cycled packaging machine which is arranged to take carton blanks that are initially supplied in a flattened condition, erect the carton and close and seal the lower end of the carton with hot melt adhesive; fill the carton, and thereafter close and seal the upper end of the carton with hot melt adhesive. The intermittently cycled packaging machine is particularly adapted for erecting, filling and closing cartons of the type shown in 27–30 and designated generally by the letter X.

The cartons are formed of paper board or the like and include opposed narrow side panels P1 and P2 interconnected along fold lines to wide side panels P3 and P4. Upper and lower end flaps F1–F4 are articulated along fold lines to the upper and lower ends of the panels P1–P4 respectively. The ends of the carton are adapted to be closed and sealed with hot melt adhesive when the end flaps are folded in a particular sequence and the adhesive is applied in a particular adhesive pattern. More particularly, when closing an end of the carton, the end flaps F1–F2 on the narrow side panels P1 and P2 are adapted to be infolded first to at least substantially close the end of the carton, followed by infolding of the end flap F3 on the wide side panel P3. Thereafter, hot melt adhesive is applied on the infolded end flaps in bands such as designated B1 and B2 in FIG. 29 that parallel the narrow side panels, and the end flap F4 on the other wide panel P4 is thereafter folded inwardly and onto the adhesive. The end flap F4 on the wide side panel P4 is dimensioned so that, when infolded last, it overlaps portions of the other end flaps F1–F3 on the respective end of the carton as shown in FIG. 30.

The carton is preferably of a so-called chest-type in which one of the wide side panels P3 functions as a cover, when the carton rests on its other wide side panel P4 as shown in FIG. 30. The wide side panel P3 has a sealing flap S articulated along one lengthwise edge and secured as by adhesive to the narrow side panel P1. To facilitate opening of the carton, a tear strip TS may be formed in the seal flap S, by discontinuous cut lines in a manner well known in the art. In order to provide a flanged cover when the carton is opened, end tabs T are advantageously provided on the ends of the seal flap S and arranged to be infolded and sealed by a spot of hot melt adhesive, to respective ones of the end flaps F3 on the wide side panel P3. In the form of the carton shown in FIGS. 27–30, a seal lip PL is connected along a fold line of one edge of the side panel P2 to engage and form a lip type seal with the panel P3 and seal lips FL are connected along a fold line to one edge of the end flaps F2 to engage and form a lip type seal with the cover when the carton is erected and closed. In the carton shown, a tear strip F3*a* is formed by a score line in the corner of each end flap F3 and is arranged to at least partially underlie and be adhesively secured to the associated end flap F4, when the latter is infolded.

The intermittently cycled packaging machine includes laterally spaced carton guides 31 and 32 spaced apart a distance to receive the cartons X with the wide side panels P3 and P4 extending crosswise therebetween, and for guiding the cartons along a path from the carton infeed station 33 past a lower carton closing station 34 to a carton filling station 35, and for guiding filled cartons from the carton filling station past an upper carton closing station 36. A carton transfer means is mounted for extension and retraction along the lateral guides 31 and 32 and has a plurality of carton engaging means at spaced locations therealong and which are operative when the transfer means is driven through a transfer cycle to advance a series of cartons along the path between the lateral carton guides in a forward step. The transfer means and the drive for the packaging machine is preferably of the type disclosed in U.S. Pat. No. 3,364,651 issued Jan. 23, 1968 and entitled "Packaging Apparatus", the disclosure of which is incorporated by reference for a more complete disclosure of the construction and operation of the transfer mechanism and the drive mechanism for the packaging machine.

As more fully disclosed in the aforementioned patent, the transfer mechanism is of the reciprocating type and includes slides mounted for reciprocation along the lateral carton guides 31 and 32. In that patent, the carton transfer slides are formed in a plurality of slide sections including an inlet slide section 43 that extends from a location adjacent the carton infeed station 33 past the lower carton closing station 34 to a location adjacent the carton filling station 35; an intermediate slide section 44 adjacent the filling station 35; an outlet slide section 45 that extends from location adjacent the carton filling station past the upper carton closing station 36 to the outlet end of the lateral carton guides. The inlet slide section 43 has a plurality of carton pushers designated 43*a*–43*e* at spaced locations therealong to advance cartons in step fashion from the carton infeed station 33 to a location in advance of the filling station 35. The intermediate slide section 44 has two sets of pushers 44*a* and 44*b* for respectively moving an empty carton to a position below the filling nozzle and for moving a filled carton away from the filling nozzle. The outlet slide section 45 has a plurality of carton pushers 45*a*–45*d* at spaced locations therealong arranged to advance cartons in step fashion from a location adjacent the outlet side of the filling station past the upper carton closing station and to the outlet end of the machine. As disclosed in that patent, the inlet and outlet sections 43 and 45 are reciprocated in unison with each other and the intermediate section 44 is reciprocated in timed relation with the inlet and outlet sections but 90 degrees out of phase therewith. As shown in FIG. 1, the several slide sections are reciprocated by a crank 51 connected to the output shaft 52 of a one revolution clutch 53 driven from a suitable motor (not shown). The crank 51 is connected through a link 55 to one end of a lever 56 that is pivoted intermediate its ends at 57, and the other end of the lever is connected through a link 58 to members (not shown) attached to the inlet and outlet slide sections 43 and 45 to reciprocate them in unison. The intermediate slide section 44 is driven from the crank 51 through a link 61 connected to one end of a lever 62 that is pivoted intermediate its ends at 63 to the frame and which is connected through a link 64 to members (not shown) attached to the intermediate slide sections to reciprocate the intermediate slide sections 90 degrees out of phase with the inlet and outlet slide sections. The one revolution clutch mechanism is arranged to normally stop the crank 51 in the position shown in FIG. 1 and, when the crank is in its stop position, the inlet and outlet slide sections 43 and 45 are in their forward position and the intermediate slide section 44 is intermediate its forward and rear positions. Thus, as shown in the timing diagram of FIG. 34, the pusher 43*e* on the inlet slide section and the pusher 45*a* on the outlet slide section are in full forward position when the crank is in its 0 degree position shown in FIG. 1, and at 0 degree, the pushers 44*a* and 44*b* of the intermediate slide section are in their intermediate position. When the clutch is engaged, it drives the crank through one revolution and back to the position shown in FIG. 1 to thereby reciprocate the inlet and outlet slide sections in timed relation with the intermediate slide section. The multiple slide section transfer mechanism disclosed in the aforementioned patent is advantageous in that it enables rapid acceleration of the filled carton away from the filling station and rapid advance of the succeeding carton to the fill station while allowing relatively slower acceleration and deceleration of the cartons as they are advanced by the inlet and outlet slide sections 43 and 45.

The filling machine has a downwardly opening filling nozzle 71 having a cross-section similar to and slightly smaller than the cross-section of the carton and which is adapted to dispense semi-fluid or plastic material such as semi-frozen ice cream, sherbet or the like in a continuous stream. The nozzle is adapted for connection, as by a fitting 72 to a conduit leading to a continuous type freezer or the like (not shown). In order to avoid interference with the semi-fluid product that is continuously emerging from the nozzle, the cartons are advanced to the filling station at a level with the tops of the cartons spaced somewhat below the lower end of the nozzle as shown in FIG. 4*a*, and the cartons are then raised at the filling station by a carton elevator 73 which moves the cartons into at least partial telescoping relation with the nozzle. The drive for the carton elevator is also of the type disclosed in U.S. Pat. No. 3,364,651, to which reference is made for a more complete disclosure. In general, the carton elevator is operated in timed relation with the transfer mechanism and, as best shown in FIG. 1, the carton elevator 73 is supported on a lever 74 that is swingably supported by a shaft 75 on the frame of the machine. An arm 76 is connected to the shaft 75 and through a link 77 to an L-shaped lever 78. One end of the L-shaped lever 78 is pivotally mounted at 79 on the frame and the other end of the lever has a follower 81 that engages a cam track 82 on a cam secured to the output shaft of the one-revolution clutch 53. In its dwell or 0 degree position shown in FIG. 1, the follower 81 is disposed adjacent the end of a relatively wide portion 82*c* of the cam track and the cam track is shaped so that, when the cam is driven through one revolution, the portion 82*a* of the can track will first move the elevator down to a position below the level of the bottom of the incoming empty carton and the portion 82*b* will thereafter raise the elevator to lift the carton into telescoping relation with the nozzle after the transfer mechanism has advanced the empty carton into a position below the nozzle, and the follower thereafter moves into a wide portion 82*c* of the cam track 82 where the elevator is allowed to move downwardly with the carton as it is filled. As diagrammatically shown in FIG. 4*a*, a switch 84 for actuating the one-revolution clutch is operated as through a switch actuator 85 herein shown connected to the elevator lever 74, when the carton being filled at the filling station moves downwardly to a level in which the top of the carton is adjacent the lower end of the nozzle. Actuation of the switch 84 operates the one-revolution clutch to drive the crank 51 and cam track 82 through one revolution. Thus, the machine is driven through a cycle each time a carton is filled. The movement of the elevator by cam 82 is diagrammatically shown by the line EL in the timing diagram in FIG. 34.

As best shown in FIGS. 2 and 3, one of the lateral carton guides 32 is relatively longer than the other lateral carton guide 31 and extends across the carton infeed station 33. A carton magazine 91 is provided to support a stack of flattened carton blanks with the end carton blank in the stack disposed at an acute angle to the lateral carton guide 32 and spaced laterally therefrom, and a carton infeed mechanism 92 is provided for feeding carton blanks from the stack and for opening and squaring the cartons. The carton infeed mechanism includes vacuum operated grippers 96 mounted on arms 97 carried by an upright shaft 98 for swinging movement about the axis of the shaft 98 through an angle between a position in which the grippers engage the face of the end carton blank in the stack and a position in which the grippers are positioned alongside the first lateral carton guide 32. The magazine 91 and carton feed means 92 are conveniently of the type disclosed in U.S. Pat. No. 3,418,893, to which reference is hereby made for a more complete description. As shown in FIG. 1, the carton infeed mechanism is operated in timed relation with the transfer mechanism from a cam track 102 that rotates with the output shaft 52 of the one-revolution clutch 53, which cam track engages a follower 103 and operates a pivotally mounted lever 104 that is connected through a link 105 to a lever on the shaft 98 for swinging the vacuum operated grippers as the cam 102 is rotated through one revolution. In general, the vacuum operated grippers are moved from a position as shown in FIG. 3 alongside the lateral carton guide 32 through an angle into engagement with the end carton in the stack in the magazine 91 during retraction of the inlet slide 43 and are then swung back to the position shown in FIG. 3 before the slide reaches its full forward position.

Figure 6:
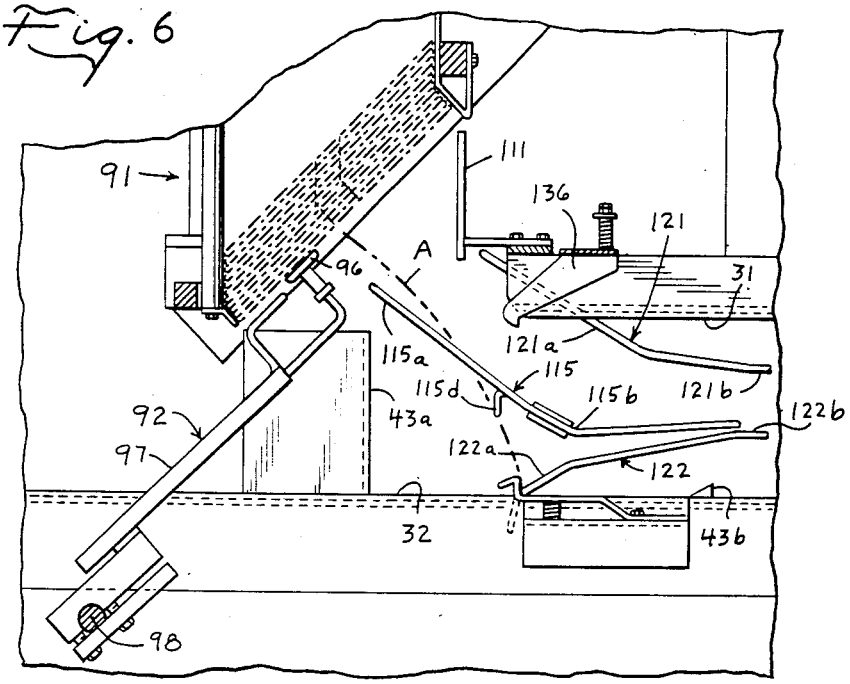
Figure 7:
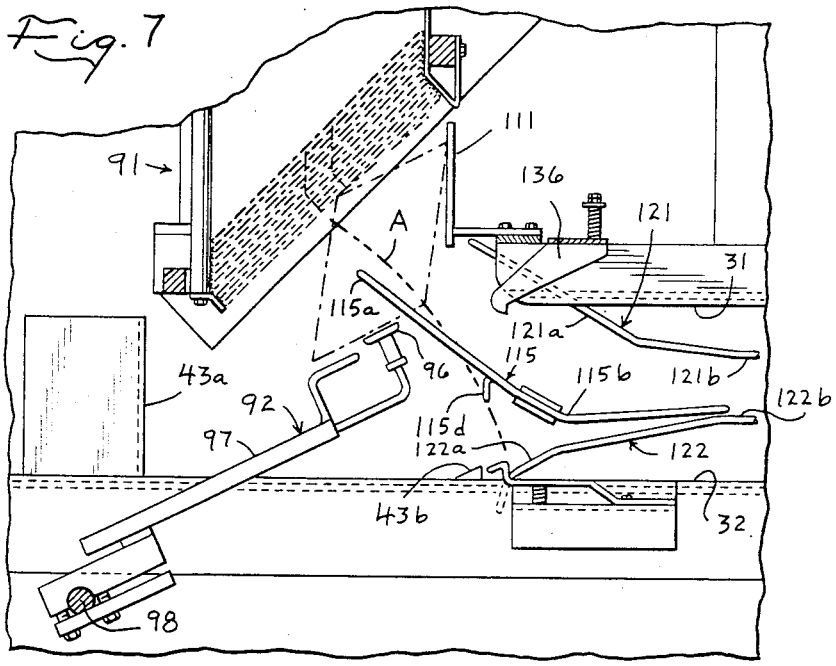
Figure 8:
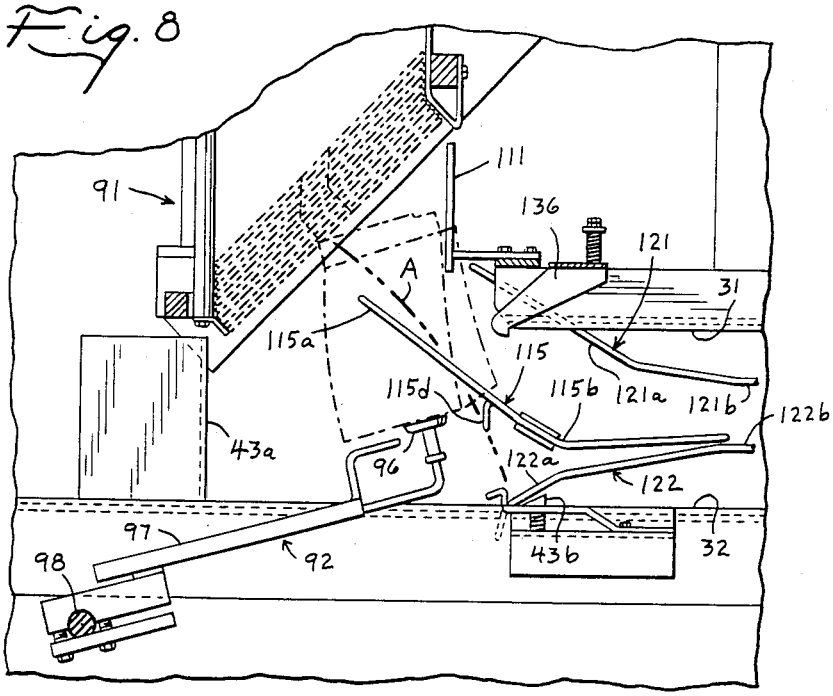
Figure 9:
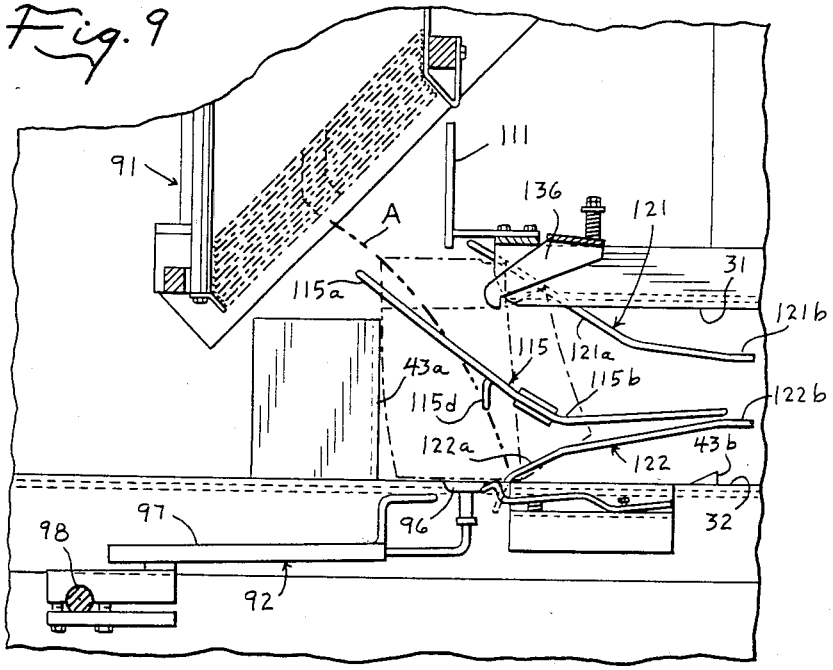

The cartons are fed from the magazine to the transfer mechanism in a manner to cause the end flaps F4 on the upper and lower ends of the panel P4 to lead during advance of the cartons through the packaging machine. For this purpose, the blanks for forming the cartons X are stored in the magazine so that the panels P1 and P4 of the end carbon blank are exposed at the end of the stack with the panel P1 located closer to the apex of the angle than the panel P4. The vacuum operated grippers 96 are arranged to engage the panel P1 and the upper and lower end flaps F2 of the end carton blank in the stack as shown in FIG. 6, and to move the side panel P1 off the stack and through an angle to a position alongside the lateral carton guide 32, as shown in FIGS. 7–9. The adjacent side edges of the end flaps F1 and F4 on the upper and lower ends of the carton move through an arc designated A in FIGS. 3 and 6–9 as the side panel P1 is moved from its position at the end of the stack as shown in FIG. 6 to its position alongside the lateral carton guide 32 as shown in FIG. 9. A carton panel engaging member 111 is provided adjacent the end of the lateral carton guide 31 and extends transverse thereto at a location to engage the panel P4 on the carton as it is moved off the stack and to a position alongside the lateral carton guide, to open and square the carton as shown in FIGS. 7 and 8.

Figure 16:
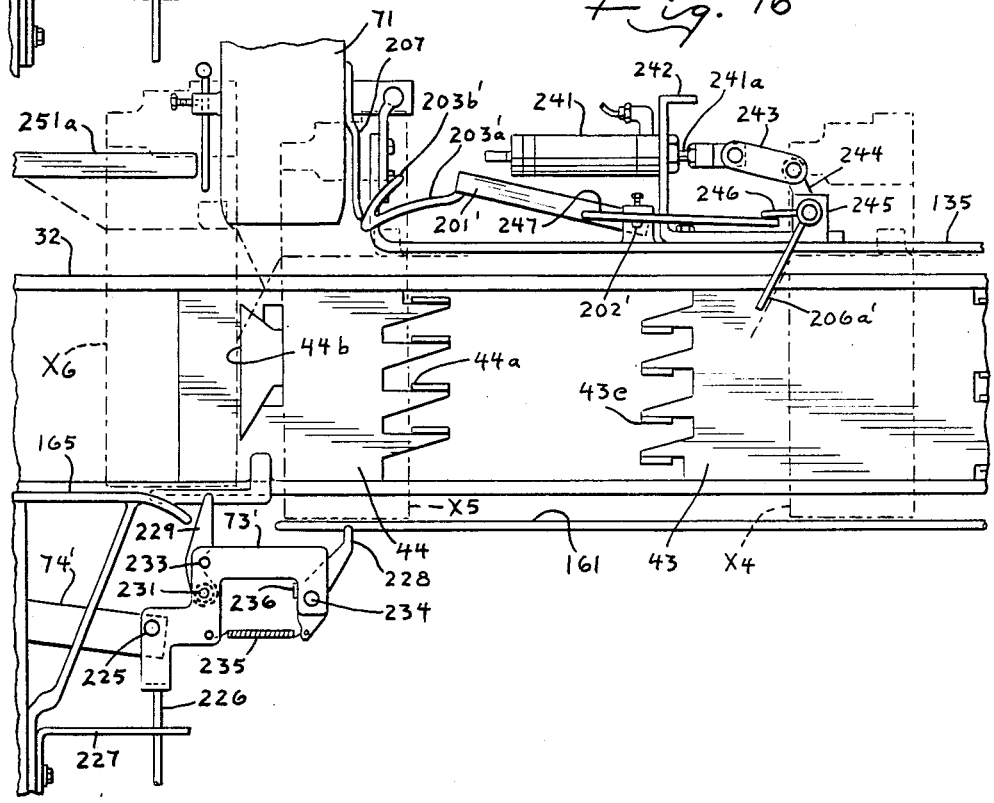

Closing of the lower ends of the cartons X requires that the end flaps F1 and F2 on the lower ends of the narrow side panels P1 and P2 be infolded first and, in order to facilitate infolding of the narrow end flaps, provision is made for deflecting the lower end flap F4 forwardly and the lower end flap F3 rearwardly prior to infolding of the flaps F1 and F2. As shown in FIG. 16, the end flaps F4 at opposite ends of the side panel P4 are relatively longer than the end flaps F2 at opposite ends of the panel P2. An elongated lower lead flap guide member 115 (FIGS. 4 and 6–9) is provided for deflecting the lower end flap F4 laterally of panel P4, as the carton is moved off the magazine into a position alongside the lateral carton guide 32. As best shown in FIGS. 6–9, the lower lead flap guide member 115 has an inlet end disposed radially inwardly of the arc of travel A of the adjacent side edges of the lower end flaps F1 and F4 and the guide member extends from its inlet end along a line as viewed in plan that intersects that arc and then terminates at an outlet end that is outwardly of the arc A. As shown in FIG. 4, the inlet end portion 115*a* of the lower lead flap guide member is disposed at a level below the lower end of the lower end flap F1 and above the lower end of the lower end flap F4 to allow the lower end flap F1 to pass thereabove while engaging and guiding the end flap F4 laterally of its panel P4. The lower lead flap guide member 115 converges upwardly in a region outwardly of the arc A toward the level of the lower ends of the cartons to further deflect the lower lead flap F4 forwardly. A lower trail flap deflecting finger 115*d* is provided on the lower lead flap guide at a level to engage the trail flap F3 on the lower end of the carton, as the carton is advanced by the pusher 43*a* on the infeed slide 43. In this manner, the lead and trail flaps on the lower ends of the cartons are deflected forwardly and rearwardly respectively to facilitate infolding of the lower end flaps F1 and F2 on the panels P1 and P2 and to also rigidify the respective panel.

First and second lateral flap folding devices are provided for infolding the end flaps F1 and F2 on the lower end of the carton. The first and second lateral flap folding devices for folding the flaps on the lower end of the carton are preferably in the form of first and second elongated lower flap guide members 121 and 122 that are disposed below the lower ends of the panels on the carton at the lower carton closing zone, and which lower flap guide members have portions 121*a* and 122*a* that converge in the direction of advance of the cartons relative to each other as shown in FIGS. 6–9 and relative to a level spaced below the lower ends of the cartons a distance approximately equal to the length of the lower trail flap F3, as shown in FIG. 4. The lower flap guides also have portions 121*b*, 122*b* that extend lengthwise of the path of movement of the cartons at a level spaced below the lower ends of the cartons a distance approximating the length of the lower trail flap F3, and outlet end portions 121*c* that converge upwardly to the level of the lower ends of the panels on the cartons. The outlet portions 121*c* guide the partially infolded lower flaps F1 and F2 into a position closing the lower end of the carton and simultaneously guide the flap F4 at the lead side of the carton forwardly of the panel P4.

A movable lower trail flap folding mechanism is provided for infolding the lower trail flap F3. The movable trail flap folding mechanism includes a pair of arms 125 (FIG. 4) mounted on a shaft 126 for swinging movement in a generally upright plane, and the arms have elongated flap engaging portions 125*a* spaced outwardly from the shaft 126 a distance to extend somewhat above the guide portion 121*c*, when the flap folding members are in their raised position as shown in dotted lines in FIG. 4. The flap folding members 125 are moved between their lower and raised positions by an actuator 128 such as a pneumatic actuator and the flap folding members are operated in timed relation with the transfer mechanism as by a suitable cam in a sequence controller 130 (FIG. 1) driven in timed relation with the clutch output shaft 52. The flap folding members 125 are normally positioned in their lower position during the dwell period of the packaging machine and, as shown by the heavy portion of the line designated LTF in the timing diagram of FIG. 34, the lower trail flap folders are moved to their raised position during retraction of the inlet slides 43 to engage the lower trail flap F3 and fold it forwardly as shown in phantom in FIG. 4, and the lower trail flap folders remain in their raised position during a portion of the subsequent forward movement of the inlet slides 43, until the carton being advanced by the pusher 43*b* reaches a position somewhat in advance of the position shown at carton dwell position X2 in FIG. 4. The flap engaging members 125 are then moved downwardly out of the path of the lower trail flap on the next succeeding carton as it advances to carton position X2.

As best shown in FIG. 3, carton stops 136 and 137 are provided for preventing retrograde movement of the cartons in the position shown at carton dwell position X1, during retraction of the slide, and another set of carton stops 138 and 139 are provided for preventing retrograde movement of the cartons at the carton dwell position X2. These carton stops are yieldably biased inwardly of the lateral carton guides and have abrupt shoulders on their trail sides for engaging the carton to prevent retrograde movement, with cam faces on the inlet side to cam the stops laterally outwardly of the guides during advance of the cartons. The carton stop 139 additionally has a nose portion 139*b* engageable with the trail side of the carton at carton dwell position X2, to laterally stabilize the carton during infolding of the trail flap on the lower end of the carton.

A lower hot melt adhesive applying mechanism is provided for applying hot melt adhesive to the infolded end flaps on the lower end of the carton in bands that generally parallel the narrow side panels P1 and P2 as the carton is advanced. The lower hot melt adhesive applying apparatus includes a pair of valved nozzles 141*a* and 141*b* which have valve actuators such as pneumatic actuators that are selectively operable to open the valves in the nozzles and dispense a stream of hot melt glue. The valve nozzles and the hot melt adhesive heating and pumping system may, for example, be of the type shown in U.S. Pat. No. 3,815,788 to which reference is made for a more complete description of the overall hot melt adhesive dispensing system.

The valve nozzles 141*a* and 141*b* are located below the cartons and are operative when actuated to dispense streams of hot melt adhesive upwardly against the underside of the infolded end flaps and are laterally positioned to direct their streams of hot melt adhesive on the infolded end flaps in strips adjacent the narrow side panels P1 and P2, as the cartons are advanced past the adhesive applying nozzles. The nozzles are positioned somewhat downstream of the trail flap folding mechanism and from the carton dwell position X2. Operation of the valved nozzles 141*a* and 141*b* is controlled by a suitable cam in the aforementioned sequence controller 130 and, as shown by the heavy portion of the line designated LA in the timing diagram of FIG. 34, the valves in the lower valved nozzles are opened only after the inlet carton transfer slide 43 has started movement of the cartons in a forward stroke and the valved nozzles are held open for a time interval sufficient to apply a strip of adhesive to the end flaps on the lower end of the carton as the carton is advanced a distance approximating the desired length of the band of adhesive. The packaging machine is particularly adapted to close and seal cartons of the type shown in FIGS. 27–30 and which are formed with end tabs T1 on the seal flap S, which end tabs must be sealed to the end flaps F3 on the panel P3, to form a cover flange. One of the valved nozzles 141*b* is arranged to apply a strip or band of adhesive to an area on the lower end flap F2 adjacent the narrow side panel P2 similar to the band indicated at B2 on the upper end of the carton in FIG. 29. The application of adhesive to the lower end flap F3 is conveniently effected through this same valved nozzle 141*b* that applies the strip of adhesive in the area on the lower end flap F2, by extending the length of the band B2 in a manner similar to that indicated at B2′ on the upper end of the carton. Preferably, the valved nozzle 141*b* is momentarily turned off and then back on as the edge of the flap F3 passes the nozzle 141*b* to avoid application of adhesive adjacent the edge of that flap. Valved nozzle 141*a* does not have to dispense adhesive onto the trail flap F3 and a separate means can be utilized to control the valve nozzle 141*a* and to dispense a shorter strip of adhesive. However, in order to simplify construction, the same cam means in the sequence controller 130 can be utilized for controlling both the valve nozzles 141*a* and 141*b* to open them for the same time interval, provided the nozzle 141*a* is arranged to apply a band or strip that is offset forwardly relatively to the path of travel of the cartons so that its strip of adhesive will commence on the underside of the lower lead flap F4 and terminate on the lower flap F1, adjacent the infolded trail flap F3 in a manner similar to that indicated at B1 in FIG. 29 on the upper end of the carton. The additional adhesive applied in the strip B1 to the underside of the lower flap F4 does not adversely affect sealing of the carton by the hot melt adhesive. While the nozzles 141*a* and 141*b* are herein diagrammatically shown as two separate nozzle structures, a single nozzle structure with two appropriately angled ports can be used to apply the adhesive strips B1 and B2.

The hot melt adhesive sets rapidly and a lower lead flap folding mechanism 151 is provided for rapidly infolding the lower lead flap F4 onto the adhesive on the previously infolded lower end flaps F1–F3, to spread the strip of adhesive and seal the flaps in a closed condition. The lower lead flap folding mechanism is arranged to infold the lower lead flap in response to advance of the carton therepast and the lower lead flap folding mechanism is positioned in sufficiently close proximity to the lower adhesive applying nozzles 141*a* and 141*b* and in relation to the carton dwell positions and stroke of the transfer mechanism so that the transfer mechanism is operative during each transfer cycle to advance a carton past the lower adhesive applying nozzles 141*a*, 141*b* and past the lower lead flap folding mechanism 151 in a continuous forward step. The transfer mechanism is shown in its rest or dwell positions in FIGS. 3 and 4 and, in the transfer mechanism dwell position, one carton is positioned at carton dwell position X2 in advance of the adhesive applying nozzles 141*a* and 141*b* and a preceding carton is positioned at carton dwell position X3, downstream of the lower lead flap folding apparatus 151. Thus, when the transfer mechanism is operated through a cycle, it advances a carton from the carton dwell position X2 past the lower adhesive applying nozzles 141*a* and 141*b* and past the lower flap folding mechanism 151 to the carton dwell position X3 in a single forward stroke. The cartons move very rapidly during the forward stroke of the transfer mechanism and the application of adhesive and infolding of the lower lead flap occurs in a very short time interval and before the applied hot melt adhesive can begin to set. Moreover, the speed of movement of the cartons from the carton dwell position X2 to the position X3 by the transfer mechanism is not affected by variations in the rate of fill of the carton or the duration of the dwell period between adjacent transfer cycles.

As shown in FIGS. 3 and 4, the lower lead flap folding mechanism comprises a stationary plow having a leading edge 15*a* that extends crosswise of the path of advance of the carton at a level offset slightly below the lower ends of the side panels, and the plow has a portion 151*b* that converges in the direction of advance of the carton to the level of the lower ends of the side panels of the cartons, and a pressure plate portion 151*c* that parallels the plane of the lower ends of the side panels to hold the closure flaps in a closed position. A lower lead flap guide 152 is provided for guiding the lower lead flap over the lead-in end 151*a* of the plow. The lower lead flap guide 152 includes a ramp portion 152*a* normally positioned in the path of advance of the lead flap of the plow and inclined downwardly and forwardly as best shown in FIG. 4 to a level below the lead-in edge 151*a*. Thus, as the carton is advanced from the carton dwell position X2 and past the lower adhesive applying nozzles 141*a* and 141*b*, the lower lead flap F4 contacts the downwardly inclined ramp portion 152*a* of the lower lead flap guide and is guided thereby below the lead-in edge 151*a* of the plow. As the carton continues movement toward the carton dwell position X3, the lead-in edge 151*a* of the plow folds the lower lead flap rearwardly in a rapid motion. As shown by the heavy portion of the line designated LLF in the timing diagram in FIG. 34, infolding of the lower lead flap occurs promptly after the termination of the application of adhesive on the lower end flaps.

The lower lead flap guide 152 is arranged so that it is shifted laterally and outwardly of the path of advance of the carton, after it has deflected the lower lead flap below the lead-in edge of the lower lead flap plow. As best shown in FIGS. 3 and 4, the lower lead flap guide has a mounting portion 152*d* that is supported as by guide pins 152*e* and 152*f* for movement in a direction laterally of the path of travel of the cartons, and the lower lead flap guide is yieldably urged as by a spring 152*g* on one or both of the guide pins to a position disposed inwardly of the path of travel of the cartons, as shown in FIG. 3. The lower lead flap guide has a second ramp portion 152*b* at the inlet end of the ramp 152*a*, and which second ramp portion is inclined laterally relative to the path of advance of the cartons as shown in FIG. 3 to engage the panel on the carton and move the lower lead flap guide laterally outwardly of the path as the carton is advanced.

Provision is made for infolding the lower tab T on the lower end of the seal flap S. The lower tab T is normally disposed in a plane generally paralleling the plane of the narrow side panel P2 and the lead flap folding mechanism includes a tab guide having an inlet portion 153*a* disposed in the plane of the lateral carton guide 31, at a position below the lateral carton guide, and a ramp portion 153*b* that is inclined forwardly and inwardly as viewed in plan (FIG. 3) and forwardly and upwardly as viewed in side elevation (FIG. 4) to guide the lower tab T laterally into underlying relation with the lower flap F3, and over the lower pressure plate portion 151*c*, as the carton is advanced. As shown in FIGS. 3 and 4, the carton dwell position X3 is advantageously located above the pressure plate 151*c* so that the lower end flaps are pressed together during the dwell period of the transfer mechanism and while the hot melt adhesive at least begins to set.

Carton infeed guide rods 161 extend from the pressure plate portion 151*c* of the lower lead flap folding plow forwardly along the path to underlie and support the cartons as they are advanced to the fill station and to hold the lower end flaps in a closed condition and allow additional time for the adhesive to set. As shown in FIG. 4*a*, the guide rods 161 are spaced below the nozzle a distance somewhat greater than the height of the carton and the carton elevator 73 is operated in timed relation with the transfer mechanism to elevate an empty carton after it has been advanced to a position below the nozzle. When the container at the filling station moves downwardly to a position in which the upper ends of the carton side panels are disposed adjacent the lower ends of the nozzle, the transfer cycle control switch 84 is actuated to drive the transfer mechanism through a succeeding transfer cycle, so that the pushers 44*b* on the intermediate slides 44 move the filled carton crosswise of the nozzles and away from the filling station and onto carton outfeed guide rails 165, while the pushers 44*a* advance a succeeding empty carton to a position below the nozzle. The carton support rails 165 extend from the filling station to the outlet end of the packaging machine at a level spaced below the lower end of the filling nozzle a distance substantially equal to the height of the side panels of the carton, to underlie and support the filled cartons.

Provision is made for out-folding the lead and trail flaps on the upper end of the carton before they reach the filling station. For this purpose, an upper lead flap guide member 131 (FIGS. 3 and 4) is provided for deflecting the upper lead flap forwardly and the upper trail flap rearwardly. As shown in FIG. 3, the upper lead flap guide member has an inlet end adjacent the end flap F1 on the upper end of the carton and the upper lead flap guide member extends from its inlet end along a line as viewed in plan that intersects the arc of travel A of the adjacent side edges of the upper end flaps F1 and F4 to an outlet end disposed intermediate the lateral carton guides 31 and 32. The upper lead flap guide member has an inlet portion 131*a* disposed at a level above the path of travel of the upper end flap F1 and below the path of travel of the upper end flap F4, as the carton is moved from the magazine to a position alongside the lateral carton guide, to allow the end flap F1 to pass therebelow during movement of a panel P1 through its angle and to engage and deflect the end flap F4 laterally of the panel P4. The upper lead flap guide member also has an outlet portion 131*b* disposed outwardly of the arc A and which is inclined downwardly and in the direction of advance of the cartons to the level of the upper ends of the side panels on the cartons, for guiding the upper lead flap F4 to a position extending forwardly from the panel P4 as the carton is advanced along the path, as best shown in FIG. 4. A finger 131*d* is provided on the lead flap guide member and extends laterally therefrom at a location to engage the trail flap F3 on the upper end of the carton, as the carton is advanced. The finger 131*d* deflects the trail flap laterally of its panel P3 and the trail flap is thereafter guide downwardly by the downwardly inclined portion 131*c* of the guide 131 to a position extending rearwardly from its panel. An upper hold down bar 135 extends along a level adjacent the top of the side panels of the cartons intermediate the lateral carton guides 31 and 32 to hold the upper lead and trail flaps in a forwardly and rearwardly extending condition respectively during advance by the inlet slide section 43.

The outlet transfer slide 45 operates to advance the filled cartons past the upper carton closing station 36 to the outlet of the packaging machine and, in its dwell or rest position, the outlet transfer slide stops the cartons at carton dwell positions designated X7, X8 and X9 in FIGS. 3*a* and 4*a*. In the embodiment of FIGS. 1–12, the upper carton closing means 36 includes first and second elongated upper lateral flap guides 171 and 172 disposed above the upper ends of the side panels on the cartons in the upper flap folding zone. As shown in FIG. 3*a*, the first and second lateral flap guides have their lead-in ends 171*a* and 172*a* spaced outwardly of the lateral carton guides 31 and 32 to engage the outer sides of the end flaps F1 and F2 to guide them inwardly, and the lateral carton guides have portions 171*b* and 172*b* that converge downwardly as shown in FIG. 4*a* and terminate in portions 171*c* and 172*c* that are disposed at the level of the upper ends of the side panels. The guides 171 and 172 are thus arranged to laterally guide the side flaps F1 and F2 inwardly and downwardly into a position closing the top of the carton. In addition, they guide the lead flap F4 on the upper end of the carton to a forwardly extending condition as shown as position X8 in FIG. 4*a*. The lateral flap guides 171 and 172 are positioned relative to the outlet slide dwell position such that, at the carton dwell position X8, the trail side panel P3 of the carton is spaced below the lateral carton guides a distance at least equal to the height of the upper trail flap F3, to allow the upper trail flap to be folded forwardly. An upper trail flap lift member 175 is mounted for extension and retraction along a path crosswise of the path of movement of the cartons adjacent the upper end of the trailing side panel P3 of the carton, at the dwell position X8. The lift member is generally wedge shaped as viewed in an upright plane perpendicular to the carton path and has a nose 175*a* at its forward end and a ramp portion 175*b* that is inclined upwardly and rearwardly from the nose and which is arranged to engage the trail flap F3 on the upper end of the carton at the carton dwell position X8 and lift the trail flap to a generally upright position. As shown in FIG. 3*a*, trail flap lift member is extended and retracted by a pneumatic cylinder 176 and actuation of the pneumatic cylinder is under the control of a valve (not shown) actuated by a cam in the sequence controller 130. The upper trail flap lifter 175 is normally in its retracted position shown in FIG. 3*a*. The upper trail flap lifter is actuated and extended to lift the trail flap shortly after the start of the transfer cycle and while the outlet transfer slide 45 is retracting, and the upper trail flap lifter is then retracted before the outlet transfer slide 45 reaches its fully retracted position.

An upper trail flap folder 178 is mounted for swinging movement on a shaft 179 in a generally upright plane adjacent the upper trail flap lift member 175. The upper trail flap folder is normally positioned in a raised position as shown in FIG. 10 during the dwell period of the machine and has an arm portion 178*a* that is arranged to engage the trail flap F3 on the upper end of the carton at carton dwell position X8 when the trail flap folder is moved to its lowered position shown in FIGS. 11 and 12. The trail flap folder 178 also has a finger portion 178*b* that is arranged to engage the lead flap F4 on the next succeeding carton at carton dwell position X7, when the trail flap folder is moved to its lowered position shown in FIG. 11. A pneumatic cylinder 181 (FIG. 3*a*) is provided for moving the upper trail flap folder between its lowered and raised positions and actuation of the cylinder is under the control of a valve (not shown) operated by a cam in the sequence controller 130. THe upper trail flap folder is moved from its normal raised position shown in FIG. 10 to its lower position shown in FIG. 11 after the upper trail flap lifter has been extended, but while the outlet slide 45 of the transfer mechanism is retracting, and the lower trail flap folder is maintained in its lower position as shown in FIG. 12 after the upper trail lifter is retracted and while the outlet transfer slide 45 advances the cartons through a portion of their forward stroke. Thus, the arm 178*a* on the upper trail flap folder holds the upper trail flap in its forwardly folded condition as the carton is advanced and until the upper trail flap underlies the portions 171*c* and 172*c* of the lateral flap guides.

Hot melt adhesive is applied to the end flaps on the upper end of the carton as the carton is advanced away from the carton dwell position designated X8 and toward the carton dwell position designated X9. Sealing of the upper end of the carton requires application of adhesive on the end flaps on the upper end of the carton in one strip B1 adjacent one narrow side panel P1 of the carton, and in a second strip B2 adjacent the other side panel P2 of the carton. As diagrammatically shown in FIGS. 3*a*, 4*a* and 8–12, valved discharge nozzles 185*a* and 185*b* are provided for applying strips of adhesive B1 and B2 on the upper end flaps on the carton, adjacent the side panels P1 and P2. The valved nozzles 185*a* and 185*b* are conveniently staggered in a direction lengthwise of the path of travel in the manner described previously in connection with the lower valved nozzles 141*a* and 141*b*, so that both valved nozzles can be turned on and off simultaneously, with one nozzle commencing application of its strip of adhesive B1 on the end flap F4 and ends on the tear tab F3*a* on the end flap F3, while the other commences application at its strip B2 on the end flap F1 and ends on the end flap F3. Thus, as shown by the heavy portion of the line designated UA in the timing diagram of FIG. 34, the upper adhesive applying nozzles are turned on and off in timed relation with the advance of the cartons by the transfer means by suitable cams in the sequence controller 130. It has been found that a single valved nozzle can be used for the upper adhesive application, if two diverging orifices are provided in the nozzle and arranged to direct diverging streams of adhesive in strips similar to strips B1 and B2.

An upper lead flap folder is provided for infolding the upper lead flap F4 into overlying relation with portions of the upper flaps F1–F3 and onto the adhesive, as the transfer mechanism advances the carton from the carton dwell position X8 to the carton dwell position designated X9 in FIG. 4*a*. In the embodiment of FIGS. 1–12, the upper lead flap folding apparatus 151' is a mirror image of the lower lead flap folding apparatus 151 and like numerals followed by the postscript ' are utilized to designate corresponding parts.

Cold products such as semi-solid ice cream and the like in the carton, accelerates setting the hot melt adhesive and the upper lead flap folding mechanism 151' is also arranged to rapidly infold the upper lead flap F4 onto the previously infolded flaps F1–F3, and onto the adhesive to spread the strips of adhesive and seal the flaps in a closed condition. The upper lead flap folding mechanism is also arranged to infold the upper lead flap in response to advance of the carton therepast and the upper lead flap folding mechanism is positioned in sufficiently close proximity to the adhesive applying nozzles 185*a* and 185*b* and in relation to the carton dwell positions and stroke of the transfer mechanism so that the transfer mechanism is operative during each transfer cycle to advance a carton past the upper adhesive applying nozzles 185*a*, 185*b* and past the upper lead flap folding mechanism 151' in a continuous forward step. The transfer mechanism is shown in its rest or dwell positions in FIGS. 3*a* and 4*a* and, in the transfer mechanism dwell position, one carton is positioned at a carton dwell position designated X8 in advance of the adhesive applying nozzles 185*a* and 185*b* and another carton is positioned at a carton dwell position designated X9, downstream of the upper lead flap folding apparatus 151'. Thus, when the transfer mechanism is operated through a cycle, it advances a carton from the carton dwell position X8 past the upper adhesive applying nozzles 185*a* and 185*b* and past the upper flap folding mechanism 151' to the carton dwell position X9 in a single forward stroke. The cartons move very rapidly during the forward stroke of the transfer mechanism and the application of adhesive and infolding of the upper lead flap occurs in a very short time interval so that the infolded lead flap can spread the strips of adhesive before the applied adhesive starts to set. Moreover, the speed of movement of the cartons from the carton dwell position X8 to the carton dwell position X9 by the transfer mechanism is not affected by variations in the rate of fill of the carton or the duration of the dwell period between adjacent transfer cycles.

The upper lead flap folding mechanism 151 is in the form of a stationary plow having a lead-in edge 151*a'* that extends crosswise of the path of advance of the carton at a level offset slightly above the upper ends of the side panels, and the plow has a portion 151*b'* that converges downwardly in the direction of advance of the carton to the level of the upper ends of the side panels of the cartons, and the pressure plate portion 151*c'* that parallels the plane of the upper ends of the side panels to hold the upper closure flaps in a closed position. An upper lead flap guide 152' is provided for guiding the upper lead flap over the lead-in end 151*a'* of the plow. The upper lead flap guide 152' includes a ramp portion 152*a'* normally positioned in the path of advance of the lead flap of the plow and inclined upwardly and forwardly as best shown in FIG. 4*a* to a level above the lead-in edge 151*a'*. Thus as the carton is advanced from the position X8 and past the upper adhesive applying nozzles 185*a* and 185*b*, the upper lead flap F4 contacts the upwardly inclined ramp portion 152*a'* and is guided thereby above the lead-in edge 151*a'* of the plow. As the carton continues movement toward the position X9, the lead-in edge 151*a'* of the plow folds the upper lead flap rearwardly in a rapid motion. As shown by the heavy portion of the line designated ULF in the timing diagram in FIG. 34, infolding the upper lead flap occurs promptly after termination of the application of adhesive on the upper end flaps.

The upper lead flap plow 152' is shifted laterally outwardly of the path of advance of the carton, after it has deflected the upper lead flap above the upper lead flap folding plow. As best shown in FIGS. 3A, 4A and 12, the upper lead flap guide means has a mounting portion 152*d'* that is supported as by guide pins 152*e'* and 152*f'* for movement in a direction laterally of the path of travel, and the upper lead flap guide is yieldably urged as by a spring 152*g'* on one or both of the guide pins to a position disposed inwardly of the path of travel of the cartons, as shown in FIG. 3*a*. The upper lead flap guide has a second ramp portion 152*b'* at the inlet end of the ramp 152*a'*, and which second ramp portion is inclined laterally relative to the path of advance of the cartons as shown in FIG. 3*a* and 12 to engage a side panel on the carton and move the upper lead flap guide laterally outwardly of the path as the carton is advanced.

Provision is made for infolding the upper tab T1 on the upper end of the seal flap S. The upper tab T1 is normally disposed in a plane generally paralleling the plane of the narrow side panel P1 and the upper lead flap folding mechanism includes an inlet tab guide 153' disposed adjacent the plane of the lateral carton guide 31 at a position above that lateral carton guide, and which tab guide has a ramp portion 153*a'* that is inclined forwardly and inwardly as viewed in plan and forwardly and upwardly as viewed inside elevation (FIG. 4A) to guide the upper tab T1 laterally into overlying relation with the upper flap F3, and under the upper pressure plate portion 151*c'*, as the carton is advanced. As shown in FIGS. 3*a* and 4*a* the carton dwell position X9 is advantageously located below the pressure plate 151*c'* so that the upper end flaps are pressed together during the dwell period of the transfer mechanism to allow the adhesive to at least start to set.

In order to prevent interference between the trail flap on the carton at the nozzle and the lead flap on the next succeeding carton, and also to prevent flaps from wiping across the product emerging from the lower end of the nozzle during movement of the cartons across the nozzle, it is necessary to deflect the trail flap on the upper end of the carton at the nozzle downwardly and to also deflect the lead flap in the next succeeding carton downwardly, and to hold the flaps in a downwardly extending position during filling and during movement of the cartons crosswise of the nozzle. In the embodiment of FIGS. 1–12, the filling station flap depressor comprises an arm 201 swingably mounted as on a pivot for movement in a generally upright plane intermediate the lateral carton guides between a lower position as shown in FIG. 4*a* and a raised position. The filling station flap depressor is gravity operated to its lower position and is supported in its lower position by engagement with the upper guide rail 135. The filling station flap depressor includes a lead flap engaging portion 203*a* which, when the arm 201 is in its lower position, extends downwardly and forwardly at a shallow acute angle of the order of 25 to 30 degrees to the horizontal, from a level above the upper end of the lead panel P4 on the carton to a level below the upper end of the lead panel on the carton, to deflect the upper lead flap F4 downwardly as the lead panel of the carton approaches the position alongside the trail panel of the carton at the fill station. The filling station flap depressor also includes a trail flap depressor portion 203*b* which extends upwardly from the forward end of the lead flap depressor portion 203*a*. The trail flap depressor portion 203*b* is spaced slightly from the inlet side of the nozzle and operates to deflect the trail flap on a carton at the filling station downwardly as that carton is elevated onto the nozzle. Guides 207 on the side of the nozzle hold the trail flap on the carton at the nozzle in a downwardly extending position as it is filled, and the trail flap depressor portion 203*b* is arranged to maintain the trail flap on the carton at the nozzle in a downwardly extending condition, as the upper end of the carton moves downwardly to the lower end of the nozzle. It was found necessary to limit the angle of the lead flap depressor portion 203*a* on the filling station flap depressor because it would drop down into the carton as soon as the lead panel on the carton moved past its lower end and it tended to hook on the trail panel and could cause deformation or trearing of the carton.

A preliminary lead flap depressor is provided for deflecting the lead flap on the carton downwardly at a location in advance of the fill station a distance greater than the width of the carton, and the preliminary lead flap depressor so arranged that it does not contact the trail side of the carton and damage or tear the carton. The preliminary lead flap depressor includes an arm 205 (FIG. 1) mounted as on a pivot for swinging movement in a generally upright plane at a location substantially in advance of the filling station between a lower position as shown in FIG. 4*a* and a raised position. The preliminary lead flap depressor is gravity urged to its lower position and the upper guide rail 125 functions as a stop to support the preliminary lead flap depressor in its lower position. The preliminary lead flap depressor has flap engaging portions 206*a* that are inclined downwardly and forwardly at a relatively shallow acute angle on the order of 25 to 30 degrees to the horizontal to engage and start bending of the lead flap downwardly as the carton is advanced, and the preliminary lead flap depressor has a second portion 206*b* that is inclined downwardly at a somewhat sharper angle to the horizontal, for example of the order of 70 to 80 degrees, to produce a relatively sharp bend between the lead flap and the lead panel, as the lead panel advances past the portion 206*b*. The preliminary lead flap depressor also has a portion 206*c* that extends forwardly from the portion 206*b* which is adapted to ride on the upper ends of the lead and trail panels of the carton and extends generally horizontally a distance greater than the width of the carton measured in a direction paralleling its path of advance. The portion 206*c* thus supports the preliminary lead flap depressor in a raised position on the upper end of the carton so that the portion 206*b* does not contact the trail side of the carton, as the trail side of the carton advances therepast.

A presently preferred embodiment of carton elevator mechanism is illustrated in FIGS. 13–20. In this embodiment, the carton elevator 73' is mounted so that its upper carton supporting surface remains substantially horizontal as the carton is raised and lowered. For this purpose, the elevator 73' is pivotally connected at 225 to the free end of the carton elevating lever 74' for raising and lowering thereby, and the carton elevating lever 74' for raising and lowering thereby, and the carton elevator is guided during raising and lowering by a guide rod 226 and a guide 227.

Figure 15:
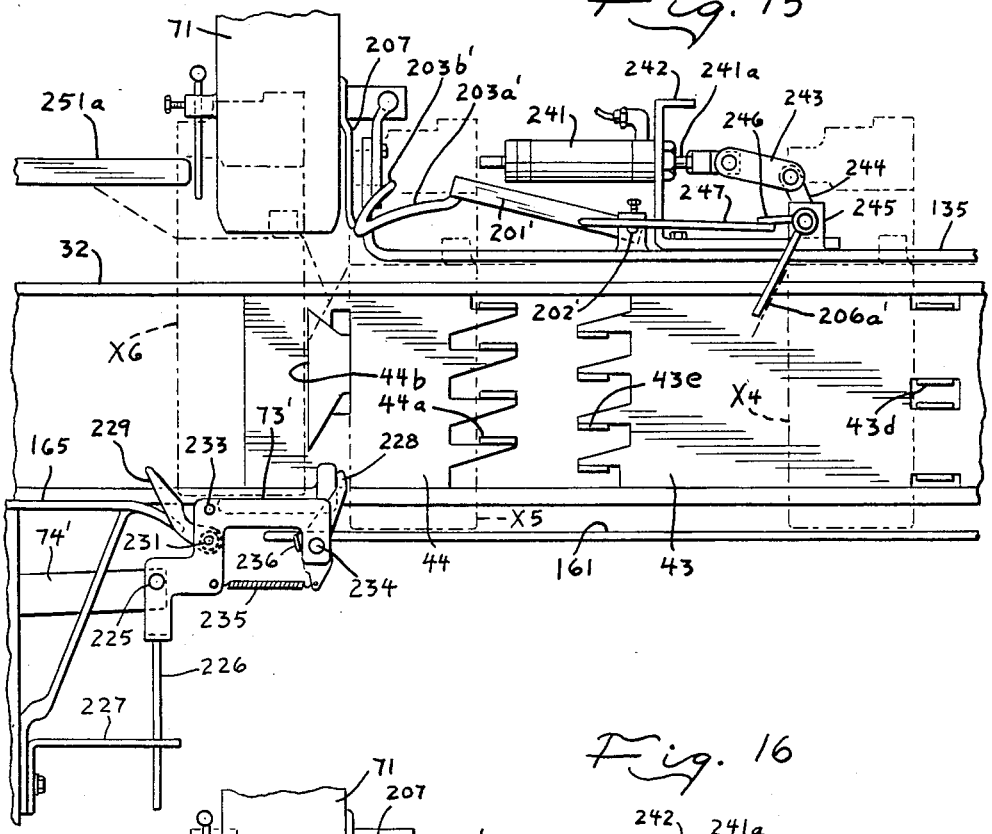

Provision is also made for releasably retaining the lower end of the carton on the elevator, to prevent tilting of the carton in a direction longitudinally of the carton feed path, during raising and lowering of the carton at the filling station. For this purpose, a first carton stabilizer 228 is mounted on the elevator and arranged to extend above the carton supporting surface on the elevator at a location to engage the trail side of the carton, and a second carton stabilizer 229 is mounted on the elevator and arranged to project above the carton supporting surface at a location to engage the lead side of the carton. In order to allow movement of a filled carton off the elevator and onto the outlet carton support 165, the carton stabilizer 229 is pivotally supported at 231 on the elevator and is yieldably biased in a clockwise direction as viewed in FIGS. 13–16 by a spring 232 (FIG. 18) and against a stop 233, to normally position the stabilizer 229 in the position shown in FIGS. 13 and 14. With this arrangement, the carton stabilizer 229 is yieldably movable in the direction of movement of the carton, when the filled carton is advanced by the intermediate pusher 44*b* off the elevator. The carton stabilizer 228 is also arranged to be yieldably movable in the direction of advance of the cartons, to avoid interference with the next succeeding carton as it is advanced to the filling station. The stabilizing member 228 is pivotally mounted at 234 for movement about a generally horizontal axis in a direction lengthwise of the path of advance of the carton and is yieldably biased by a spring 235 to a position in which a stop 236 on the stabilizer member engages a portion of the elevator, to normally position the stabilizer member 228 to engage the trail side of the carton on the elevator. Thus, the carton stabilizer 228 is yieldably movable in the direction of advance of the cartons, when it is engaged with the lead side of the next succeeding carton being advanced to the filling station as shown in FIG. 15. As previously described, when the packaging machine is cycled in response to activation of the carton fill switch 84, the portion 82*a* of the elevator drive cam 82 moves the elevator downwardly while the intermediate pusher 44*b* advances a filled carton away from the filling station and the pusher 44*a* advances a carton to the filling station. When the elevator is in its lower position shown in FIG. 16, the carton stabilizer 228 is below the level of the carton infeed support rails 161 and the carton stabilizer 229 is below the level of the outfeed carton support 165 so that the stabilizers can return to their upright positions. The portion 82*b* of the elevator drive cam raises the elevator after the next succeeding carton is advanced to the filling station and the carton stabilizing members 228 and 229 then move with the elevator and respectively engage the trail and lead sides of the carton.

A preferred form of upper lead flap depressor apparatus is illustrated in FIGS. 13–17, to depress the lead flap on the carton when it is advanced to a position adjacent the filling station, to prevent interference with the carton at the filling station. A first upper lead flap depressor is provided for depressing the lead flap of the carton when the carton is at a first carton infeed dwell position designated X5 immediately in advance of the filling station. The first flap depressor includes an arm 201' swingably mounted on a pivot 202' for movement in a generally upright plane intermediate the lateral carton guides between a lower position as shown in FIG. 13, and a raised position as shown in FIGS. 14–16. The first flap depressor is gravity operated to its lower position and is supported in its lower position by engagement with the upper guide rail 135. The first flap depressor includes a lead flap engaging portion 203*a'* which, when the arm 201 is in its lower position, extends downwardly and forwardly at a shallow acute angle of the order of 25 to 30 degrees to the horizontal, from a level above the upper end of the lead panel P4 on the carton to a level below the upper end of the lead panel on the carton, to deflect the upper lead flap F4 downwardly as the carton is advanced to the first carton infeed dwell position X5 adjacent the carton fill dwell position X6 at the fill station. The first flap depressor also includes a trail flap depressor position 203*b'* which extends upwardly from the forward end of the lead flap depressor portion 203*a'*. Guides 207 on the nozzle hold the trail flap on the carton at the nozzle in a downwardly extending position when it is raised and during the initial portion of its downward movement, and the trail flap depressor portion 203*b'* is arranged to maintain the trail flap on the carton in a downwardly extending condition as the upper end of the carton moves downwardly to the lower end of the nozzle.

A power operated device, conveniently in the form of a fluid actuating cylinder 241, is provided for selectively raising the lead flap depressor. The cylinder 241 is mounted as by a bracket 242 on the upper guide rail 135 and has its piston rod 241*a* connected through a link 243 to a crank arm 244 that is rotatably supported by a bracket 245 on the upper guide rail 135. An actuating member 246 is mounted for movement with the crank arm 244 and is arranged to engage the rearwardly extending end of a lever 247 that is fixed to the arm 201', to raise the arm when the cylinder 241 retracts the piston rod 241*a* and moves the member 246 in a counterclockwise direction to the position shown in FIG. 14. The cylinder 241 is operated by a valve (not shown) under the control of sequence controller 130 and the valve is arranged to be operated when the elevator moves down to a position in which the upper end of the carton is adjacent the lower end of the nozzle. Thus, the upper lead flap depressor is raised as shown in FIG. 14 as the carton at first carton infeed dwell position X5 starts movement toward the carton fill dwell position X6 at the filling station. The fill switch 84 remains energized as the elevator is lowered to a position below the infeed carton support 161 as shown in FIG. 16 and the power operated actuator 241 holds the lead flap depressor in its raised position until the next succeeding carton is advanced to a postion below the nozzle. In this manner, the upper lead flap depressor is moved to a raised position and held in that raised position while the intermediate pusher 44*a* advances a carton from position X5 to position X6. The upper end flap depressor is lowered before the inlet pusher 43*e* advances a carton from position X4 to position X5, to depress the lead flap on that carton. The heavy line UD1 in the timing diagram in FIG. 34 indicates the portion of the cycle during which the first lead flap depressor is in its lower position.

A second flap depressor 206*a'* is advantageously provided to pre-bend the lead flap on the upper end of the carton downwardly before it reaches the first carton infeed dwell position X5 adjacent the filling station. As shown in FIGS. 13–17, the second lead flap depressor 206*a'* is positioned to engage the lead flap on the upper end of the carton when it is at a second carton infeed dwell position designated X4. The second lead flap depressor 206*a'* is conveniently operated by the same power actuator cylinder 241 utilized to raise the first lead flap depressor. In the embodiment shown, the second lead flap depressor 206*a'* is mounted for angular movement with the crank arm 244. As previously described, the inlet and intermediate transfer sections 43 and 44 are operated 90 degrees out of phase with each other and the inlet transfer section 43 starts to retract as the intermediate transfer section moves forwardly. The fluid actuator cylinder 241 operates the second lead flap depressor to move it to its lower position while raising the first lead flap depressor, as shown in FIGS. 14–16. The heavy line designated UD2 in the timing diagram in FIG. 34 indicates the portion of the cycle during which the second upper lead flap depressor is in its lower position.

A preferred embodiment of upper flap folding mechanism is illustrated in FIGS. 18–26. In the embodiment of FIGS. 1–12, the side flaps F1 and F2 on both ends of the carton were infolded by flap guides as the cartons were advanced by the transfer mechanism, and the trail flap was folded by a swingably mounted arm while the cartons were at dwell position, and the lead flap was thereafter infolded by a plow during advance of the cartons. While that arrangement was found to work satisfactorily on the lower end of the cartons, problems were encountered in infolding the flaps on the upper end of the carton after filling. The problems encountered in closing the upper end of the carton are caused in part by the need to outfold certain upper end flaps in order to avoid interference with the adjacent cartons during filling and also to avoid wiping of the flaps against the material emerging from the nozzle as the carton was moved across the nozzle. These problems were aggravated when sealing lips designated FL in 27 and 28 are provided on the carton to aid in sealing the cartons against leakage. During opening and squaring of the carton, the sealing lips on lower flap F2 engages the downwardly extending lower trail flap F3 and is folded thereby to a position extending laterally of the lower flap F2. However, the sealing lip FL on the upper flap F2 must be disposed substantially in the plane of the upper flap F2 when the carton is filled, and it is necessary to fold the seal lip laterally of the upper flap F2 during infolding of that flap.

The upper lead flap F1 is infolded by an elongated flap guide 251 as the carton is advanced from the dwell position X6 at the filling station, past a dwell position X7 and to a dwell position X8, as shown in FIG. 20. The flap guide 251 is an elongated blade like member having an inlet end portion 251*a* that converges laterally as shown in FIG. 18 relative to the path of travel of the cartons from the dwell position X6 toward the dwell position X7, and which is disposed at a level as shown in FIG. 20 to engage the end flap F1 to guide the same laterally inwardly. Flap guide 251 also has an intermediate portion 251*b* that extends lengthwise of the path of travel of the cartons as shown in FIG. 18, and which has a lower edge spaced above the top of the carton a distance substantially less than the height of the flap F1 to guide the flap to a partially infolded position, and a portion 251*c* that is inclined downwardly toward the level of the top of the carton, and which terminates at a location spaced from the trail side of the carton at the dwell position X8. The flap guide 251 is recessed in an area 251*d* in a region above the trail side panel on the carton at the dwell position X8, which recess is shaped to allow the trail flap F3 on the upper end of the carton to be raised upwardly and folded inwardly while the carton is at a dwell position X8. The outlet end 251*e* of the guide is disposed at the level of the top of the carton and is arranged to engage the flap F1 on the upper end of the carton to hold it in an infolded position at the level of the top of the carton.

In this embodiment, the upper side flap F2 and the upper trail flap F3 are infolded in that sequence while the carton is at the dwell position X8. A second flap folding device is provided for infolding the second end flap and includes an arm 255 mounted for swinging movement about a pivot axis 256 at one side of the path of travel of the cartons and adjacent the upper edge of the second side panel. The flap folding arm 255 is operated by an operating means including a fluid actuator 258 having a piston rod 258*a* connected to a member 259 for reciprocating the member in a direction transverse to the path of movement of the carton. The member 259 is connected by a link 261 to the flap folding arm 255 to move the arm from a raised position as shown in FIG. 23 when the piston rod 258*a* is retracted, to a lower position as shown in FIG. 25 when the piston rod is extended. In order to avoid interference with infolding of the trail flap, the flap folding arm 255 is positioned so as to engage the upper flap F2 at a location spaced forwardly of the panel F3 a distance greater than the height of the trail flap F3. The arm 255 is advantageously provided with a depending lip 255*a* at its outer edge arranged to engage an edge portion F2*a* of the flap F2. The pivot axis 256 of the arm is offset laterally from the hinge point of the flap F2 on the panel P2 and the length of the arm 255 is arranged so that the lip 255*a* will engage the edge F2*a* and urge the flap F2 in a direction toward the panel P2, to assure that the panel P2 is pressed firmly against the lateral carton guide 31. This overcomes the tendency of the panel P2 to buckle inwardly due to panel flexibility resulting from the provision of a sealing flap S and tear strip TS on the carton. For reasons which will become apparent hereinafter, the edge portion F2*a* of the upper flap F2 is located inwardly at least a short distance from the outer edge portion F2*b* of the end flap F2 in the region adjacent the flap lip FL.

In cartons of the type having lateral seal lip FL on the upper flap F2, it is also necessary to fold the lip FL laterally of the flap F2 during infolding of the latter. For this purpose, a lip folding finger 265 is mounted on the member 259 for movement thereby. The lip folding finger 265 is normally positioned outwardly of the path of the travel of the cartons as shown in FIGS. 18, 23, and 26, and it is positioned on the member 259 to extend alongside the trail edge of the upper flap F2 when it is extended. The finger 265 projects forwardly of the folding arm 255, when the piston rod 258*a* is in its retracted position, to engage and infold the flap lip FL before the flap F2 is folded downwardly. A resilient flap restraining finger 266 is mounted on a stationary portion of the machine at a level to engage the free edge of the flap F2 as shown in FIG. 23, to hold the flap F2 against swinging movement while the finger 265 infolds the lip FL. When the flap is thereafter engaged by the folding arm 255, the finger 266 is arranged to yield and allow the flap to swing downwardly with the flap folding arm as shown in FIGS. 24 and 25.

The trail flap F3 is usually depressed below the level of the top of the carton, due to down-folding at the filling station, and a flap lifting finger 268 is mounted on the member 259 for movement thereby. The finger 268 is normally retracted outwardly of the path of movement of the cartons and is shaped and arranged to engage the trail flap F3 of the upper end of the carton when the piston rod 258*a* is extended, to lift the trail flap to a level substantially above the top of the carton.

The upper trail flap F3 is infolded while the carton is at the dwell position X8 and while the second flap folding mechanism is in its extended or flap folding position. The upper trail flap folder includes an arm 271 that is mounted on a shaft 272 for swinging movement in an upright plane generally paralleling the path of travel of the cartons and above the top of the carton at the dwell position X8. A fluid cylinder 273 of an arm operating mechanism has its piston rod 273*a* connected through a link 274 to a lever rigid with the shaft 272 to move the arm 271 from a raised position as shown in FIGS. 18 and 20 when the piston rod 273*a* is retracted, to a lower position as shown in FIG. 22 when the piston rod is extended. The arm 271 moves in a vertical plane that is beyond the ends of the lip folding finger 265 and the flap lifting finger 268 when they are extended as shown in FIG. 25. The arm 271 has a nose portion 271*a* that extends laterally of the lower end of the arm and moves in an arc downwardly and forwardly to engage the upper trail flap F3 of the carton in the dwell position X8, to fold the same forwardly into overlying relation with the upper side flaps F1 and F2. As previously described, the flap folding guide 251 has a recess 251*d* shaped to allow the trail flap to be folded upwardly and inwardly.

Interference between the flap seal FL on the upper end flap F2 and the upper trail panel F3 sometimes occurred in the region adjacent the outer edge of the flap F2 and this interference inhibited proper infolding of the upper flap F2 in that region. In order to overcome this problem, an auxiliary flap folding arm is provided and secured at its upper end to a tubular sleeve 279 that is rotatably supported on a stationary shaft 280. The auxiliary arm 278 is mounted for swinging movement in a direction generally lengthwise of the carton path and has a nose portion 278*a* at its lower end engageable with the outer face of the second flap F2 in a region adjacent the end edge F2*b*, when the flap F2 is infolded. The auxiliary arm 278 is operated in timed relation with the trail flap folding arm 271 and has a cam track with crest portions 278*b* and 278*c* engageable with a follower 282 on the arm 271. The arm 278 is yieldably biased in a rearward direction by a spring 283 and a follower 282 on the flap folding arm 271 engages the crest portion 278*b* when the arm 271 is in raised position, to position the nose portion 278*a* forwardly of the trail wall of the carton at the dwell position X8. As the arm 271 moves downwardly to an intermediate position shown in FIG. 21, the follower 282 moves into a recess between the crest portions 278*b* and 278*c* so that the arm 278 moves rearwardly to press the outer edge of the flap F2 downwardly into full closed position, and continued downward movement of the trail flap folding arm 271 causes the follower to ride on the crest portion 278*c* of the cam track and move the auxiliary arm 278 forwardly out of the path of the trail flap F3 as it is infolded, as shown in FIG. 22. The upper trail flap folder remains in its lower position until the carton transfer mechanism starts the transfer of the carton away from the dwell position X8, to hold the trail flap in its closed position, at least until the carton has been advanced to a position in which the trail flap is held down by the outlet portion 251*e* of the flap guide 251. A rearwardly projecting finger 271*b* is provided on the lower end of the arm 271 and is arranged to converge downwardly and forwardly relative to the carton dwell position X8 when the arm 271 is in its lower position shown in FIG. 22, to guide the lead flap on the next succeeding carton downwardly.

The cartons at position X8 dwell during the first 180 degrees of crank movement and as diagrammatically shown by the heavy line designated USF in FIG. 34, the upper side flap folding arm 255 is operated shortly after the start of the cycle to fold the side flap F3 downwardly and to hold the side flap down until the upper trail flap folder moves down, as shown by the heavy line UTF. The upper trail flap folder is held in its lower position until outlet transfer pusher 45*c* moves the carton away from position X8.

Upper adhesive applicators 285*a* and 285*b* (FIG. 20) are provided for applying adhesive to the upper end of the carton in two laterally spaced strips of bands designated B1 and B2 in FIG. 29. As previously described, the applicators are arranged to direct two streams of adhesive B1 and B2 onto the flaps on the upper end of the carton as the carton is advanced. A switch 282 (FIG. 18) is provided for controlling operation of the adhesive applicators 285*a* and 285*b* and is herein shown operated by a carton sensing finger 284, the finger 284 is positioned to sense advance of the carton past the adhesive applicators 285 to control adhesive application. The adhesive applicator 285*b* can be momentarily interrupted to apply a separate strip or spot of adhesive B2′ on the trail flap F3 in an area to underlie the tab T. As indicated by the heavy lines UA in the timing diagram in FIG. 34, the upper adhesive applicators are operated to dispense adhesive as the cartons are advanced away from the dwell position X8 and toward the next succeeding dwell position X9 and before the lead flaps are infolded.

An upper lead flap folding mechanism is provided for folding the upper lead flap after the adhesive has been applied to the infolded end flaps on the carton, and before the carton reaches the carton dwell position X9. An upper flap guide 286 extends from the carton dwell position X8 to hold the lead flap on the upper end of the carton in a generally horizontal position during application of adhesive and to continue to hold the side and trail flaps F2 and F3 in a closed position. The lead flap folder includes an arm 287 pivotally mounted at 288 for vertical swinging movement in a plane generally paralleling the path and at a location intermediate the dwell positions X8 and X9. The arm 287 has a hook portion 287*a* at its lower end facing in a direction opposite the direction of advance of the cartons along the path to engage the lead edge of the lead flap F4 as the carton is advanced away from the carton dwell position X8 toward the dwell position X9, to lift and infold the lead end flap as the carton is advanced as indicated by the heavy line ULF in FIG. 34.

A means is provided for infolding the tab T on the upper end of the carton, after the carton reaches the dwell position X9. As best shown in FIG. 18, the tab folder comprises a tab folding member 301 supported on the piston rod 302*a* of a fluid actuator 302, for movement between a retracted position outwardly of the path of movement of the cartons and an extended position to depress the tab T downwardly onto the adhesive spot B2′. Fluid actuator 302 is controlled by a valve (not shown) operated in timed relation with the transfer mechanism, to extend the tab folding member when the carton is dwelling at position X9 and to retract the tab folding member after the carton at position X9 moves away from the tab folding member, to allow the next carton to advance to position X9. The heavy line designated Tb in FIG. 34, indicates the portion of the transfer cycle during which the tab folding member is extended. Hold down plows 305 and 306 are provided above the carton dwell position X9 and extend to the outlet end of the filling machine to hold the end flaps in a closed condition until the adhesive has set up.

The sealing lips FL were provided on the end flaps F2, to aid in sealing the ends of the carton against leakage. However, leakage problems were encountered even with cartons having sealing lips FL on the end flaps. The leakage problems were primarily at the end of the carton that was closed after filling, and was found to be due to the bulging of the trail and lead sides of the containers caused by the product dispensed into the open top of the cartons. During closing of the carton, the upper trail and lead flaps F3 and F4 are infolded after infolding of the upper side flaps F1 and F2. However, when the trail and lead panels P3 and P4 are bulged outwardly by the product, some distortion of the upper end of the carton remains after infolding of the upper trail and lead flaps.

An upper carton reshaping means is provided at the carton dwell position X9, to reshape the upper end of the carton after it is closed and while the adhesive is setting. The upper carton reshaping means is mounted above the carton dwell position X9 as shown in FIGS. 18 and 20, and includes trail and lead shoes 311 and 312 arranged for engagement with the upper trail and lead sides of the carton at that dwell position. The shoes 311 and 312 are mounted for movement into and out of a lower position adjacent the trail and lead sides of the carton and are movable relative to each other while at that lower position to press the trail and lead panels toward each other. As best shown in FIGS. 20 and 31–33, a fluid actuator 314 having movable piston rod 314*a* is mounted by a bracket 315 on the packaging machine above the carton dwell position X9, and a head 313 is mounted on the piston rod 314*a* for vertical movement thereby between a raised position shown in FIG. 31 and a lower position shown in FIG. 33. A guide 316 attached to bracket 315 slidably engages the head 313 to prevent turning of the head about the axis of the piston rod during raising and lowering of the head. The head has first and second depending portions 313*a* and 313*b*, and the shoes 311 and 312 are respectively connected by first and second pairs of parallel links 318*a* and 318*b* and pivot pins 319 and 320 to the depending portions 313*a* and 313*b*. The shoes 311 and 312 respectively have stops 311*a* and 312*a* arranged to engage the head to limit downward movement of the shoes to a first position in which the pairs parallel links 318*a* and 318*b* extend downwardly and inwardly as shown in FIG. 31. The shoes 311 and 312 respectively have generally horizontal surfaces 311*b* and 312*b* arranged to engage the infolded trail and lead flaps F3 and F4 on the upper end of the carton and generally upright surfaces 311*c* and 312*c* arranged to engage the trail and lead side panels of the carton adjacent their upper ends. When the shoes are supported by the links in their first position on the head. The generally upright surfaces 311*c* and 312*c* of the shoes are spaced apart a distance greater than the distance between the trail and lead panels of the carton. When the head is moved downwardly from its raised position, it reaches an intermediate position at which the horizontal surfaces 311*b* and 312*b* on the shoes engage the trail and lead flaps on the carton and interrupt downward movement of the shoes. As the head continues downward movement from the intermediate position to a lower position shown in FIG. 33 the links 318*a* and 318*b* shift the shoes 311 and 312 toward each other to press the upright surfaces 311*c* and 312*c* against the trail and lead panels and move the latter toward each other. The first and second end flaps have a width the same as the width of the respective first and second side panels and are infolded before the trail and lead end flaps. The shoes are arranged to press the upper portions of the trail and lead panels into contact with the edges of the first and second end flaps. This reshapes the upper end of the carton to make the spacing between the trail and lead side panels substantially correspond to the width of the first and second side panels. Pressing the upper portions of the trail and lead panels against the side edges of the first and second end flaps also effectively eliminates gaps and leakage paths therebetween.

The carton dwell position X9 is the next dwell position after the carton closing dwell position X8. As previously described, adhesive is applied in bands B1 and B2 on the upper end of each carton and the upper lead flap is infolded as the carton is advanced from position X8 to position X9. The actuator 314 is operated by a valve (not shown) controlled by sequence, controller 130. As shown by the heavy line designated CS in the timing diagram of FIG. 34, the operation of actuator 314 is timed to move the head 313 down to its lower position shown in FIG. 33 when the carton is advanced to position X9, and to hold the head and shoes 311 and 312 in that position while the adhesive is setting. The head 313 is raised before the outlet transfer slide starts to advance a carton away from position X9. The tear tab F3*a* is advantageously provided on the trail and flap F3 at a location to underlie a portion of the lead end flap and the adhesive applying means is arranged to apply adhesive to the upper side of tab F3*a* so that it is adhesively secured to the lead flap when the carton is closed. This provides a direct connection between the lead flap and one end of the trail flap when the carton is closed, to aid in holding that end of the trail flap against shifting when the reshaping shoes are released. The other end of the trail flap is held by the tab T.

From the foregoing it is thought that the construction and operation of the intermittently cycled packaging machine will be readily understood. While several embodiments of the invention are herein shown and described, persons skilled in the art to which it pertains will appreciate a number of changes and modifications which may be made without departing from the spirit of the invention. Therefore, I do not intend to be limited except by the scope of the appended claims.

The embodiments of the invention in which an exclusive property or privilege is claimed are defined as follows:

1. A packaging apparatus for erecting, filling and closing cartons having first and second opposed side panels and third and fourth opposed side panels articulated to the first and second side panels along lengthwise edges, the cartons having first, second, third and fourth end flaps respectively articulated along at least the upper end of the first, second, third and fourth side panels and adapted to be infolded to close said one end of the carton, the fourth end flap being dimensioned such that, when infolded last, it overlaps portions of the first, second and third end flaps, the packaging apparatus including a carton infeed zone; a lower carton closing zone; a filling station; and an upper carton closing zone arranged in the order named along a horizontal path, a carton guide means for guiding cartons along said path, means including a filling nozzle at the filling station for filling cartons, carton transfer means extending along the path and having a plurality of carton engaging means at spaced locations therealong and operative when the transfer means is driven through a transfer cycle to advance a series of cartons forwardly in step fashion along the path with the cartons stopping at dwell positions spaced along the path after each advance, one of the dwell positions being a fill dwell position at the filling station and one other of the dwell positions being an upper closing dwell position intermediate the ends of the upper carton closing zone, transfer drive means operative when container at the filling station is filled for driving the transfer means through a transfer cycle, a carton magazine at the carton infeed station for storing a stack of cartons in the form of flattened tubular carton blanks, carton infeed means for feeding an end carton from the stack to the carton guide means with the lengthwise edges of the panels upright and for opening and squaring the carton blank, lower carton closing means at the lower carton closing zone for closing the lower end of the carton, an upper carton closing means at the upper carton closing zone for closing the upper end of the carton, the improvement wherein the carton infeed means is arranged to deposit cartons at the carton infeed zone so that the fourth side panel of the carton leads the third side panel during advance along said path, the carton closing means for closing the flaps on the upper end of the carton including a first flap folding device for infolding the first end flap on the upper end of the carton, a second flap folding arm mounted for swinging movement about a pivot axis at one side of said path and adjacent the upper edge of the second side panel of the carton at said upper closing dwell position, a first operating means for moving said second flap folding arm between a raised position extending upwardly from its pivot axis at said one side of said path and a lower position extending generally horizontally from its pivot axis and crosswise of said path to infold the second end flap on the upper end of the carton, a third flap folding device adjacent said upper closing dwell position and movable to engage and infold the third end flap on the upper end of the carton forwardly, a second means for operating said third flap folding device, means operative while the carton is dwelling at said upper closing dwell position for sequentially actuating said first operating means and said second operating means to sequentially infold the second and third end flaps on the upper end of the carton, a lead flap folding mechanism for folding the fourth end flap on said upper end of the carton rearwardly into overlying relation with portions of the first, second and third end flaps, the lead flap folding mechanism being spaced along said path in the direction of advance of the carton from said upper closing dwell position and being operable to fold the fourth end flap rearwardly in response to advance of the carton therepast, adhesive applying means at a location intermediate the third flap folding mechanism and the lead flap folding mechanism for applying hot melt adhesive to areas on the end flaps on said upper end of the carton as the cartons are advanced past the adhesive applying means, said adhesive applying means and said lead flap folding mechanism being positioned along said path in sufficiently close proximity and at locations such that the transfer mechanism is operative during each transfer cycle to advance a carton past the adhesive applying means and past the lead flap folding mechanism in a continuous forward step, said first operating means including a member at said one side of said path, means for moving said member in a direction transverse to the path alternately toward and away from said path, and means connecting said member to said second flap folding arm for swinging the latter from its raised to said lower position in response to movement of said member toward said path, a third flap lift device mounted on said member for movement thereby crosswise of the path at a location adjacent the third side panel of the carton at said upper closing dwell position and operative when the member is moved toward said path to lift the third end flap of the carton from a position below the upper end of the carton to a position projecting above the third side panel for engagement by said third flap folding means.

2. A package apparatus according to claim 1 wherein said second flap folding arm has a depending flange spaced from its pivot axis at a location to engage a portion the free edge of second end flap as the said second flap folding arm is moved to its lower position.

3. A packaging apparatus according to claim 1 for use with cartons having a seal lip connected by a fold line along the edge of the second end flap that is adjacent the third side panel, a lip folding device on said member at a location to engage and fold the seal lip laterally of said second end flap as the second flap folding arm moves the second end flap toward its lower position.

4. A packaging apparatus according to claim 1 for use with cartons having a seal lip articulated along the edge of the second end flap that is adjacent the third side panel, means at said upper closing dwell position for folding the seal lip laterally of the second end flap as the second flap folding arm is moved toward its lower position.

5. A packaging apparatus according to claim 1 wherein said third flap folding device includes a third flap folding arm mounted for swinging movement about a pivot axis crosswise of said path and spaced above the carton at the said upper closing dwell position, said second operating means being operable to swing said third flap folding arm from a raised position downwardly and forwardly about its axis to a lower position to engage and forwardly fold the third end flap on the upper end of the carton.

6. A packaging apparatus according to claim 5 including an auxiliary arm mounted above the carton at the upper closing dwell position for movement in a direction generally lengthwise of said path, the auxiliary arm having a nose portion engageable with the outer face of the second end flap when it is infolded, auxiliary arm operating means for moving the auxiliary arm in timed relation with the third upper flap folding arm initially in a rearward direction to depress the free end of the second end flap and then in a forward direction out of the path of the third end flap as the latter is infolded by the third flap folding device.

7. A packaging machine according to claim 6 wherein said means for moving the auxiliary arm includes a cam follower on said flap folding arm and a cam track on said auxiliary arm engaged by said cam follower.

8. A packaging apparatus according to claim 1 wherein said lead flap folding mechanism includes a fourth flap folding arm mounted for vertical swinging movement in a plane generally paralleling said path and at a location intermediate the upper closing dwell position and the next succeeding carton dwell position, said fourth flap folding arm having a hook portion at its lower end facing in a direction opposite the direction of advance of cartons along the path to engage the lead edge of the fourth end flap as the carton is advanced away from the upper closing dwell position to lift and infold the fourth end flap.

9. A packaging apparatus according to claim 1 including an upper flap depressor arm mounted for vertical swinging movement between a lower and a raised position having a lead flap depressor portion extending forwardly and downwardly into the path of movement of the upper end of the carton at a location adjacent the inlet side of the filling station to depress the lead flap on the upper end of a carton when it is advanced to a first infeed dwell position adjacent the inlet side of the filling station, and means actuated in timed relation with the transfer means for moving the upper flap depressor arm to its raised position as the transfer means advances a carton from the first infeed dwell position to the filling station and for holding the upper flap depressor arm in its raised position until the trailing side panel on that carton has advanced past the flap depressor portion to thereby prevent the flap depressor portion from engaging the trailing side panel of the carton.

10. A packaging apparatus according to claim 1 including upper carton reshaping means at an upper sealing dwell position next succeeding the upper closing dwell position, said upper carton reshaping means including trail and lead shoes, and means operated in timed relation with the carton transfer means and while a carton is dwelling at said upper sealing dwell position for moving the trail and lead shoes into pressing engagement with upper portions of respective trail and lead panels and for moving the upper portions of the trail and lead panels toward each other and into contact with the edges of the first and second end flaps on the upper end of the carton.

11. A packaging apparatus according to claim 1 including upper carton reshaping means mounted above the path at an upper sealing dwell position next succeeding the upper closing dwell position, said upper carton reshaping means including a head mounted for vertical movement between a raised position and a lower position, trail and lead shoes each having a generally horizontal surface adapted to engage respective ones of the infolded third and fourth end flaps on the upper end of a carton and a generally upright surface extending below its horizontal surface and respectively adapted to engage the third and fourth side panels adjacent their upper ends, and linkage means mounting the trail and lead shoes on the head, said linkage means normally supporting said trail and lead shoes in a first position on the head, with their upright surfaces spaced apart a distance greater than the spacing between the third and fourth side panels as the head is moved from its raised to an intermediate position at which the horizontal surfaces on the trail and lead shoes engage the respective trail and lead flaps on the upper end of a carton, said linkage means being arranged to shift the trail and lead shoes toward each other as the head moves downwardly from its intermediate to its lower position to press the upper portions of trail and lead panels toward each other and into contact with the edges of the first and second end flaps on the upper end of the carton, and means for moving said head between its raised position and its lower position in timed relation with said transfer means.

12. A packaging apparatus for erection, filling and closing cartons having first and second opposed side panels and third and fourth opposed side panels relatively wider than the first and second side panels and articulated thereto along lengthwise edges, the cartons having first, second, third and fourth end flaps respectively articulated along at least the upper end of the first, second, third and fourth side panels and adapted to be infolded to close said one end of the carton, the fourth end flap being dimensioned such that, when infolded last, it overlaps portions of the first, second and third end flaps, the packaging apparatus including a carton infeed zone; a lower carton closing zone; a filling station; and an upper carton closing zone arranged in the order named along a path, a carton guide means for guiding cartons along said path, means including a filling nozzle at the filling station for filling cartons, carton transfer means extending along the path and having a plurality of carton engaging means at spaced locations therealong and operative when the transfer means is driven through a transfer cycle to advance a series of cartons along the path in a forward step, transfer drive means operative when a container at the filling station is filled for driving the transfer means through a transfer cycle, a carton magazine at the carton infeed station for storing a stack of cartons in the form of flattened tubular carton blanks, carton infeed means for feeding an end carton from the stack to the carton guide means with the lengthwise edges of the panels upright and for opening and squaring the carton blank, lower carton closing means at the lower carton closing zone for closing the lower end of the carton, an upper carton closing means at the upper carton closing zone for closing the upper end of the carton, said carton infeed means being arranged to deposit cartons at the carton infeed zone so that the fourth side panel of the carton leads the third side panel during advance along said path, said upper carton closing means including first and second flap folding devices for infolding the first and second end flaps on said upper end of the carton, a trail flap folding mechanism for folding the third end flap on said upper end of the carton forwardly into overlapping relation with portions of the first and second end flaps; a lead flap folding mechanism for folding the fourth end flap on said upper end of the carton rearwardly into overlying relation with portions of the first, second and third end flaps, the lead flap folding mechanism being spaced along said path in the direction of advance of the carton from the trail flap folding mechanism and being operable to fold the fourth end flap rearwardly in response to advance of the carton therepast, adhesive applying means at a location intermediate the trail flap folding mechanism and the lead flap folding mechanism for applying hot melt adhesive to areas on the end flaps on such upper end of the carton as the cartons are advanced past the adhesive applying means, said adhesive applying means and said lead flap folding mechanism being positioned along said path in sufficiently close proximity and at locations such that the transfer mechanism is operative during each transfer cycle to advance a carton past the adhesive applying means and past the lead flap folding mechanism in a continuous forward step to an upper sealing dwell position, an upper carton reshaping means at said upper sealing dwell position, said upper carton reshaping means including trail and lead shoes, and means operated in timed relation with the carton transfer means and while a carton is dwelling at said upper sealing dwell position for moving the trail and lead shoes into pressing engagement with upper portions of respective trail and lead panels and for moving the upper portions of the trail and lead panels toward each other and into contact with the edges on the first and second end flaps on the upper end of the carton, said upper carton reshaping means including a head mounted for vertical movement between a raised position and a lower position, said trail and lead shoes each having a generally horizontal surface adapted to engage respective ones of the infolded third and fourth end flaps on the upper end of a carton and a generally upright surface extending below its horizontal surface and respectively adapted to engage the third and fourth side panels adjacent their upper ends, and linkage means mounting the trail and lead shoes on the head, said linkage means normally supporting said trail and lead shoes in a first position on the head with the upright surfaces spaced apart a distance greater than the spacing between the third and fourth side panels as the head is moved from its raised to an intermediate position at which the horizontal surfaces on the trail and lead shoes engage the respective trail and lead flaps on the upper end of a carton, said linkage means being arranged to shift the trail and lead shoes toward each other as the head moves downwardly from its intermediate to its lower position and press the upper portions of trail and lead panels toward each other.

13. A packaging apparatus for erecting, filling and closing cartons having first and second opposed side panels and third and fourth opposed side panels articulated to the first and second side panels along lengthwise edges, the cartons having first, second, third and fourth end flaps respectively articulated along the upper end of the first, second, third and fourth side panels and adapted to be infolded to close the upper end of the carton, the packaging apparatus including a carton infeed zone; a lower carton closing zone; a filling station; and an upper carton closing zone arranged to the order named along a path, first and second spaced lateral carton guides for guiding cartons along said path, carton transfer means mounted for extension and retraction along opposite sides of the path and having a plurality of carton engaging means at spaced locations therealong and operative when the transfer means is driven through a transfer cycle to advance a series of cartons forwardly in step fashion along the path with the cartons stopping at a series of dwell positions spaced along the path, transfer drive means operative when a container at the filling station is filled for driving the transfer means through a transfer cycle, a carton magazine at the carton infeed station for storing a stack of cartons in the form of flattened tubular carton blanks, carton infeed means for feeding an end carton from the stack to the carton guide means with the lengthwise edges of the panels upright and for opening and squaring the carton blank, lower carton closing means at the lower carton closing zone for closing the lower end of the carton, means including a filling nozzle at the filling station for filling cartons, means at the filling station for elevating a carton into at least partial telescoping relation with the nozzle, an upper carton closing means at the upper carton closing zone for closing the upper end of the carton, the improvement comprising an upper flap depressor arm mounted at a location along the path in advance of the filling station for vertical swinging movement between a lower and a raised position, said upper flap depressor arm in its lower position having a lead flap depressor portion extending forwardly and downwardly into the path of movement of the upper end of the carton at a location adjacent the inlet side of the filling station to depress the lead flap on the upper end of a carton when it is advanced to a first infeed dwell position adjacent the inlet side of the filling station, and means actuated in timed relation with the transfer means for moving the upper flap depressor arm to its raised position as the transfer means advances a carton from the first infeed dwell position to the filling station and for holding the upper flap depressor arm in its raised position until the trailing side panel on that carton has advanced past the flap depressor portion to thereby prevent the flap depressor portion from engaging the trailing side panel of the carton, a second lead flap depressor arm mounted for vertical swinging movement at a location along the path between a lower position engaging the lead flap on the upper end of a carton at a second infeed dwell position in advance of the first infeed dwell position and a raised position, and means operating said second lead flap depressor arm in timed relation with said transfer means for moving the second lead flap depressor arm to its raised position as the transfer means advances a carton from the second infeed dwell position toward the first infeed dwell position and for holding the second flap depressor arm in its raised position until that carton has advanced past the second flap depressor arm.

14. A packaging apparatus according to claim 13 wherein a single fluid actuator is arranged to operate both said first and said second lead flap depressor arms.

* * * * *

UNITED STATES PATENT AND TRADEMARK OFFICE

CERTIFICATE OF CORRECTION

PATENT NO. : 4,569,184

DATED : February 11, 1986

INVENTOR(S) : Leo Strombeck

It is certified that error appears in the above-identified patent and that said Letters Patent are hereby corrected as shown below:

Column 1, after "Inventor:" insert:

[73] Assignee: APV Anderson Bros. Inc., Rockford, Illinois

Signed and Sealed this

*Twenty-seventh* Day of *May 1986*

[SEAL]

*Attest:*

DONALD J. QUIGG

*Attesting Officer*

*Commissioner of Patents and Trademarks*